US011525578B2

(12) United States Patent
Natarajan et al.

(10) Patent No.: US 11,525,578 B2
(45) Date of Patent: Dec. 13, 2022

(54) DYNAMICS-MITIGATING ADAPTER FOR BUNDLED TUBE FUEL NOZZLE

(71) Applicant: General Electric Company, Schenectady, NY (US)

(72) Inventors: Jayaprakash Natarajan, Greer, SC (US); Sven Georg Bethke, Greenville, SC (US)

(73) Assignee: General Electric Company, Schenectady, NY (US)

( * ) Notice: Subject to any disclaimer, the term of this patent is extended or adjusted under 35 U.S.C. 154(b) by 284 days.

(21) Appl. No.: 15/678,263

(22) Filed: Aug. 16, 2017

(65) Prior Publication Data

US 2019/0056112 A1 Feb. 21, 2019

(51) Int. Cl.

| | |
|---|---|
| ***F23R 3/28*** | (2006.01) |
| ***F23R 3/50*** | (2006.01) |
| ***F23R 3/46*** | (2006.01) |

(52) U.S. Cl.

CPC ..... *F23R 3/283* (2013.01); *F23R 3/286* (2013.01); *F23R 3/46* (2013.01); *F23R 3/50* (2013.01)

(58) Field of Classification Search

CPC .. F23R 3/283; F23R 3/286; F23R 3/30; F23R 3/32; F23D 14/62; F23D 14/64; F23D 11/40

See application file for complete search history.

(56) References Cited

U.S. PATENT DOCUMENTS

| | | | | |
|---|---|---|---|---|
| 4,100,733 | A | 7/1978 | Striebel et al. | |
| 4,408,461 | A * | 10/1983 | Bruhwiler | F23R 3/32 60/737 |
| 4,845,952 | A | 7/1989 | Beebe et al. | |
| 4,966,001 | A | 10/1990 | Beebe et al. | |
| 5,361,586 | A | 11/1994 | McWhirter et al. | |
| 5,943,866 | A | 8/1999 | Lovett et al. | |
| 6,164,055 | A | 12/2000 | Lovett et al. | |
| 7,578,130 | B1 | 8/2009 | Kraemer et al. | |
| 7,886,991 | B2 | 2/2011 | Zuo et al. | |
| 8,147,121 | B2 | 4/2012 | Lacy et al. | |
| 8,261,555 | B2 | 9/2012 | Uhm et al. | |
| 8,875,516 | B2 | 11/2014 | Uhm et al. | |
| 8,904,798 | B2 | 12/2014 | Manoharan et al. | |
| 8,925,324 | B2 | 1/2015 | Berry et al. | |
| 8,943,832 | B2 | 2/2015 | Uhm et al. | |
| 9,134,030 | B2 | 9/2015 | Bathina et al. | |
| 9,188,335 | B2 | 11/2015 | Uhm et al. | |
| 9,347,668 | B2 * | 5/2016 | Westmoreland | F23R 3/286 |

(Continued)

*Primary Examiner* — Scott J Walthour
*Assistant Examiner* — David P. Olynick
(74) *Attorney, Agent, or Firm* — Fletcher Yoder, P.C.

(57) ABSTRACT

A combustor having bundled tube fuel nozzles is provided. At least one of the fuel nozzles has a dynamics-mitigating adapter removably coupled thereto. The adapter includes a mounting body defining at least one flow passage aligned with an inlet of at least one tube of the at least one fuel nozzle. The at least one flow passage extends an axial length of the at least one tube. The adapter may include extenders aligned with each tube of the fuel nozzle, and the extenders may have identical or different lengths. Adapters may be used for each fuel nozzle of the combustor. The mounting body may be a monolithic unit through which the flow passages are defined or may include a plurality of extenders affixed to and extending upstream of the mounting body.

20 Claims, 16 Drawing Sheets

(56) References Cited

U.S. PATENT DOCUMENTS

| | | | | |
|---|---|---|---|---|
| 9,353,950 | B2 | 5/2016 | Uhm et al. | |
| 2008/0268387 | A1 | 10/2008 | Saito et al. | |
| 2012/0180487 | A1 | 7/2012 | Uhm et al. | |
| 2013/0104556 | A1* | 5/2013 | Uhm | F23L 7/005 60/772 |
| 2013/0283810 | A1* | 10/2013 | Idahosa | F23R 3/286 60/776 |
| 2013/0318975 | A1* | 12/2013 | Stoia | F23R 3/283 60/737 |
| 2014/0150434 | A1* | 6/2014 | Belsom | F23R 3/286 60/739 |
| 2014/0157779 | A1* | 6/2014 | Uhm | F23R 3/286 60/725 |
| 2014/0338338 | A1* | 11/2014 | Chila | F23R 3/10 60/737 |
| 2015/0226435 | A1* | 8/2015 | Melton | F23R 3/286 60/737 |
| 2016/0040882 | A1* | 2/2016 | Cihlar | F23R 3/286 60/738 |
| 2016/0146469 | A1* | 5/2016 | Lum | F23R 3/286 60/737 |
| 2016/0178206 | A1* | 6/2016 | Yoshino | F23R 3/32 60/738 |

* cited by examiner

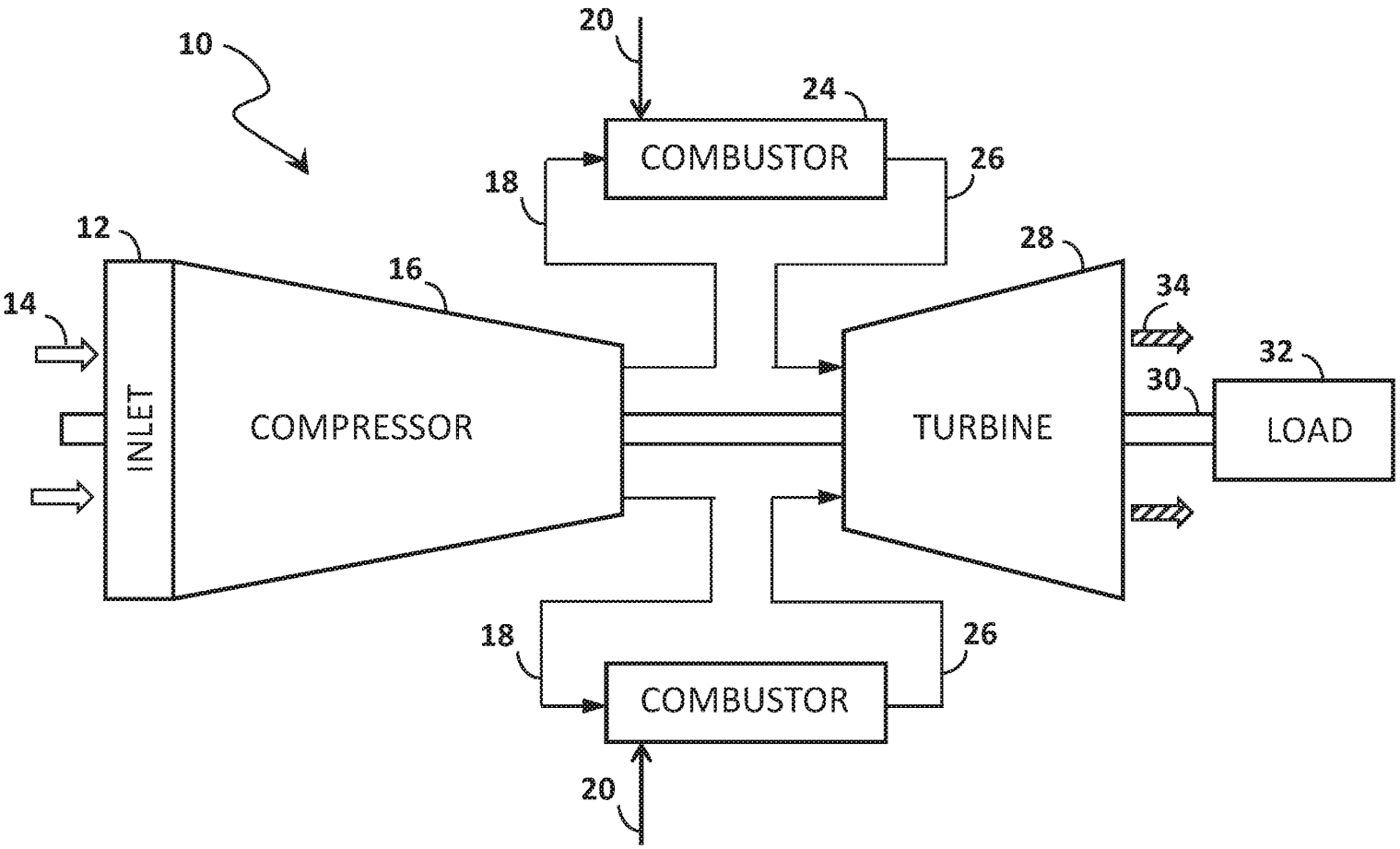
-- FIG. 1 --

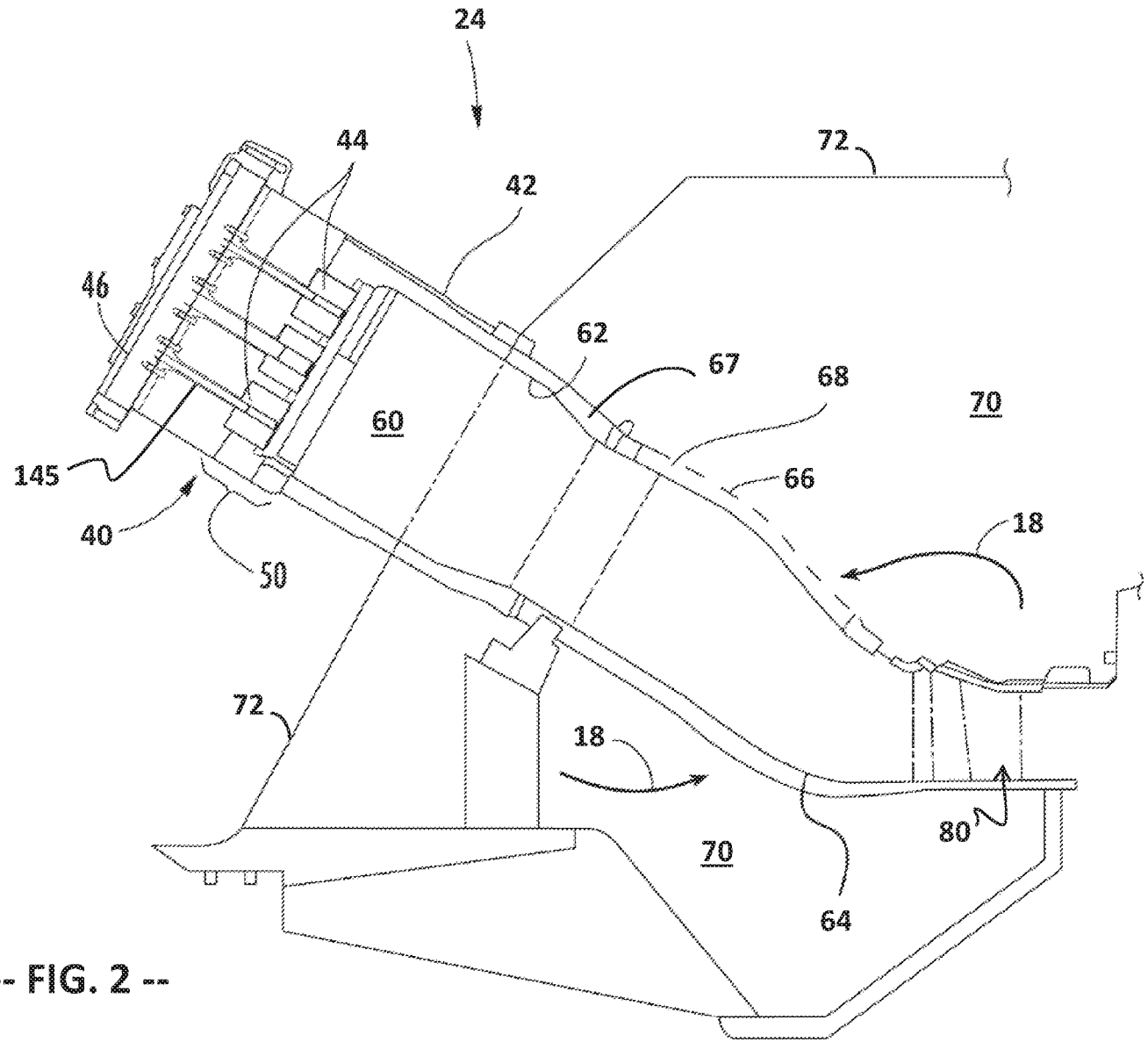
-- FIG. 2 --

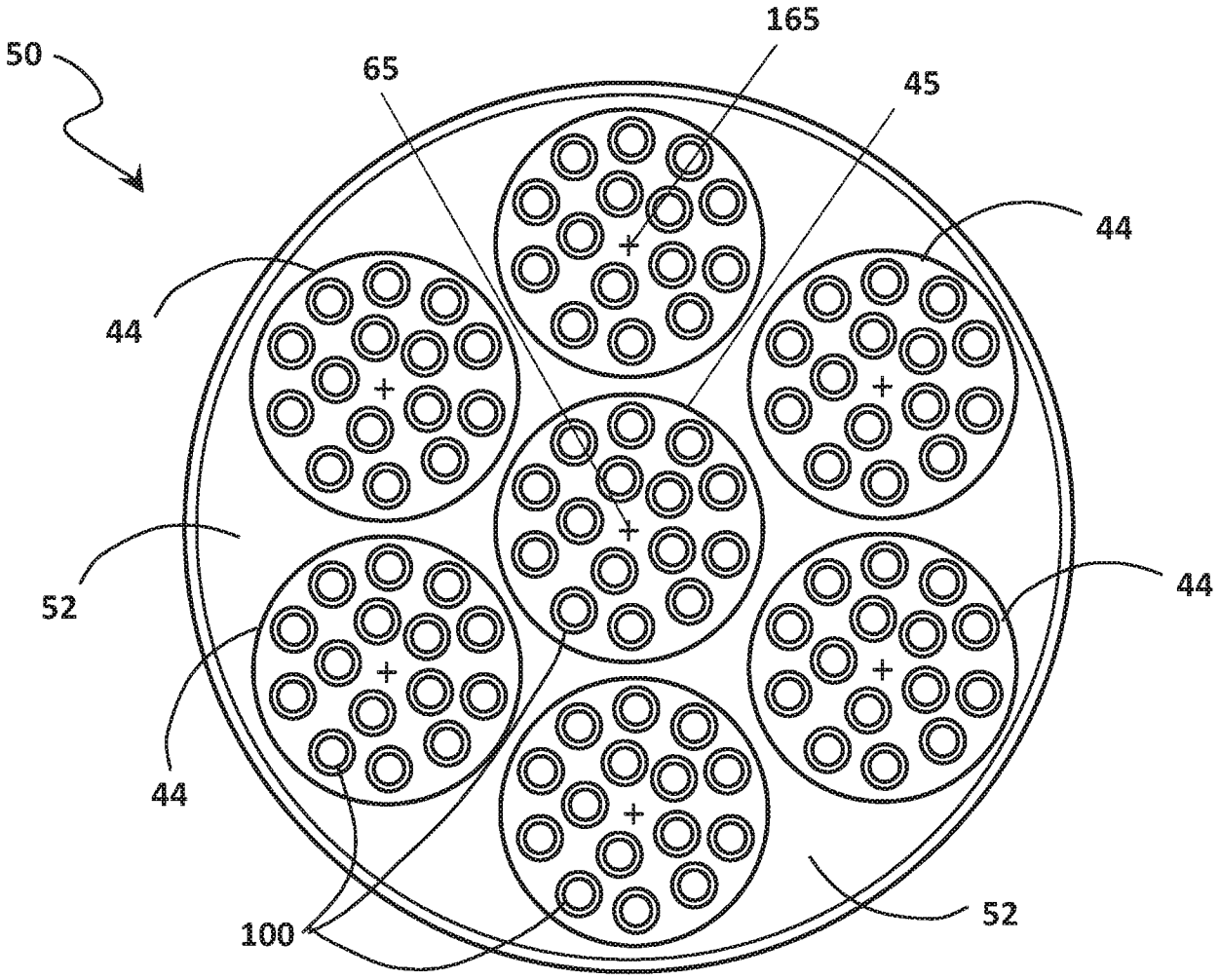
-- FIG. 3 --

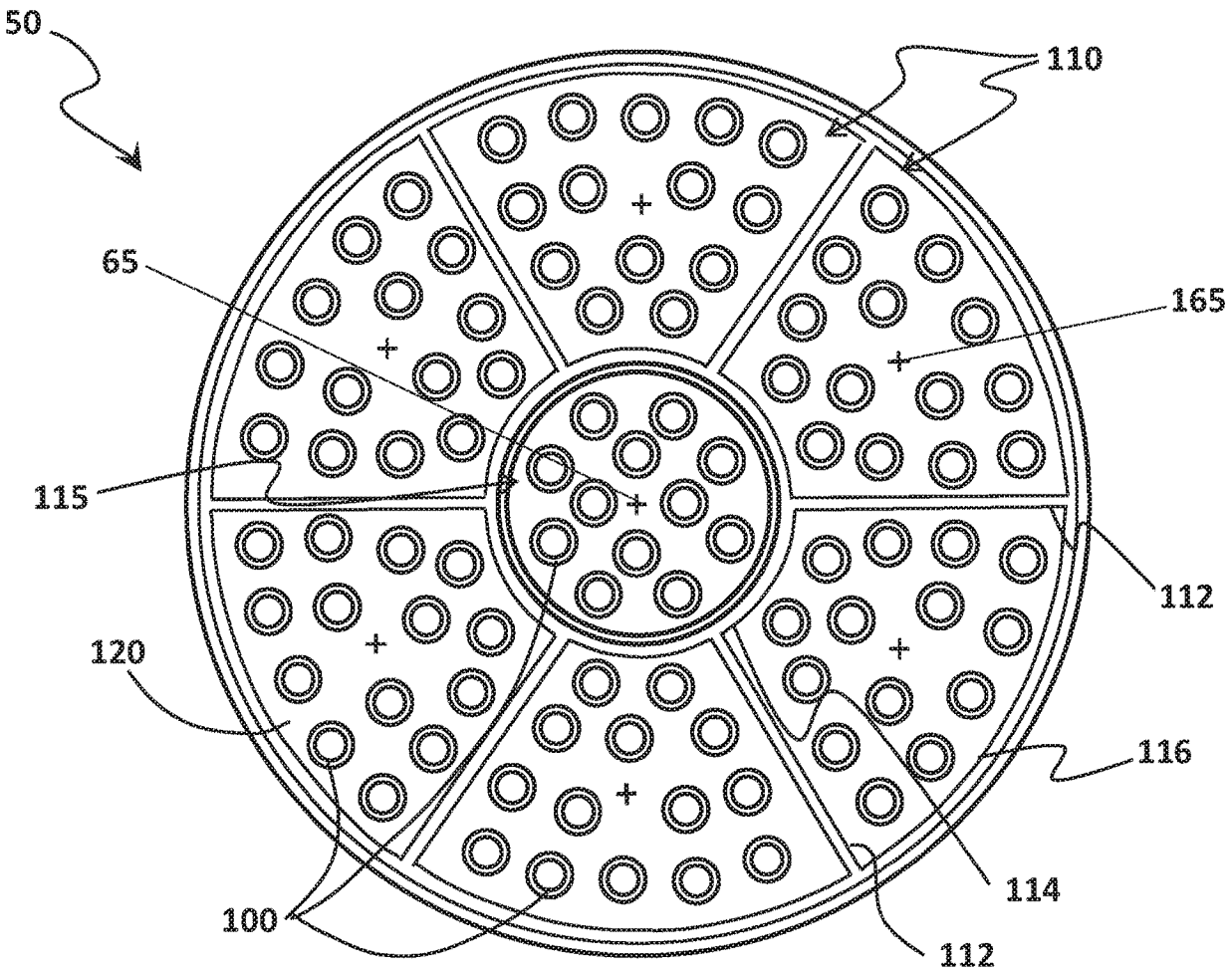
-- FIG. 4 --

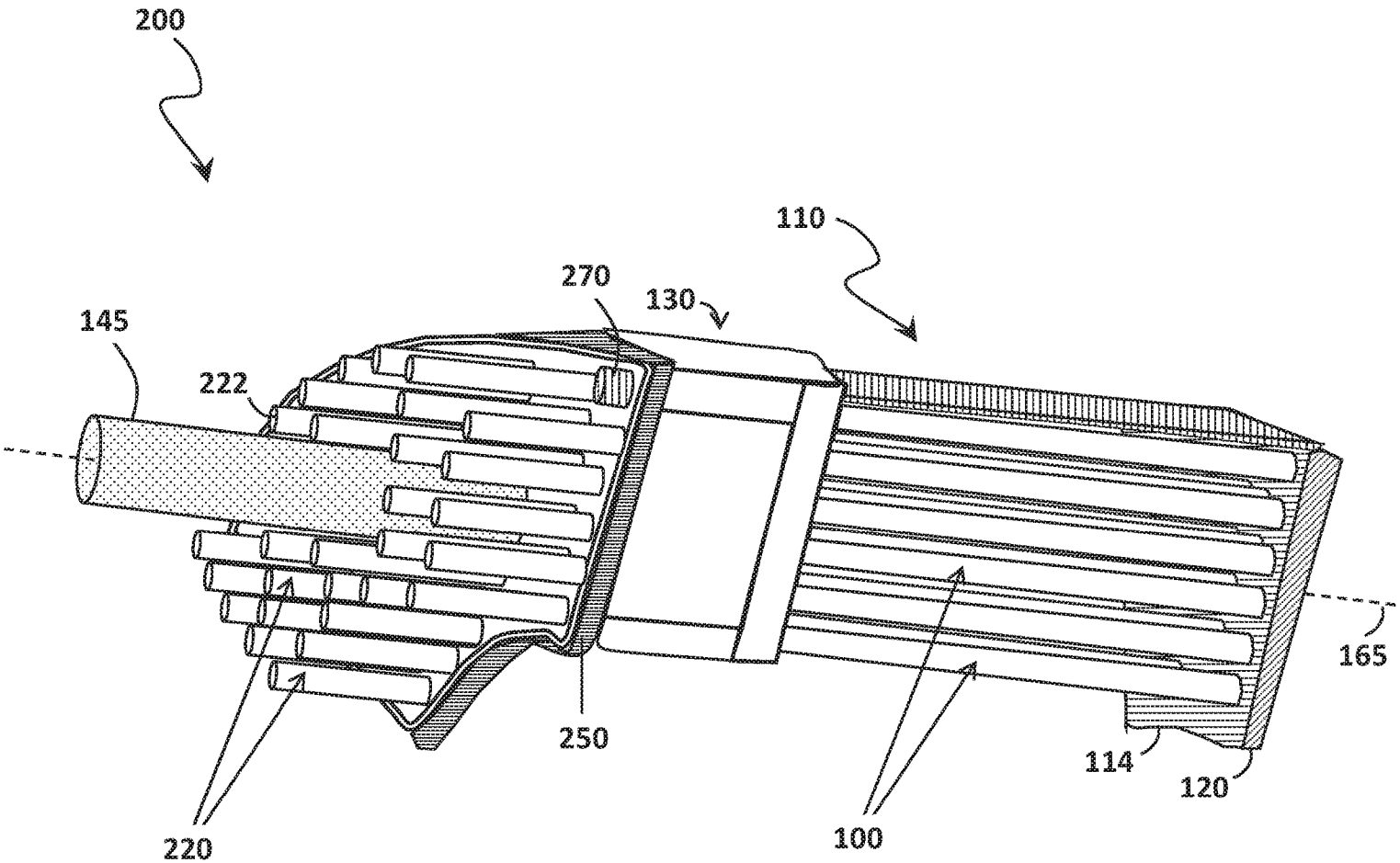
-- FIG. 5 --

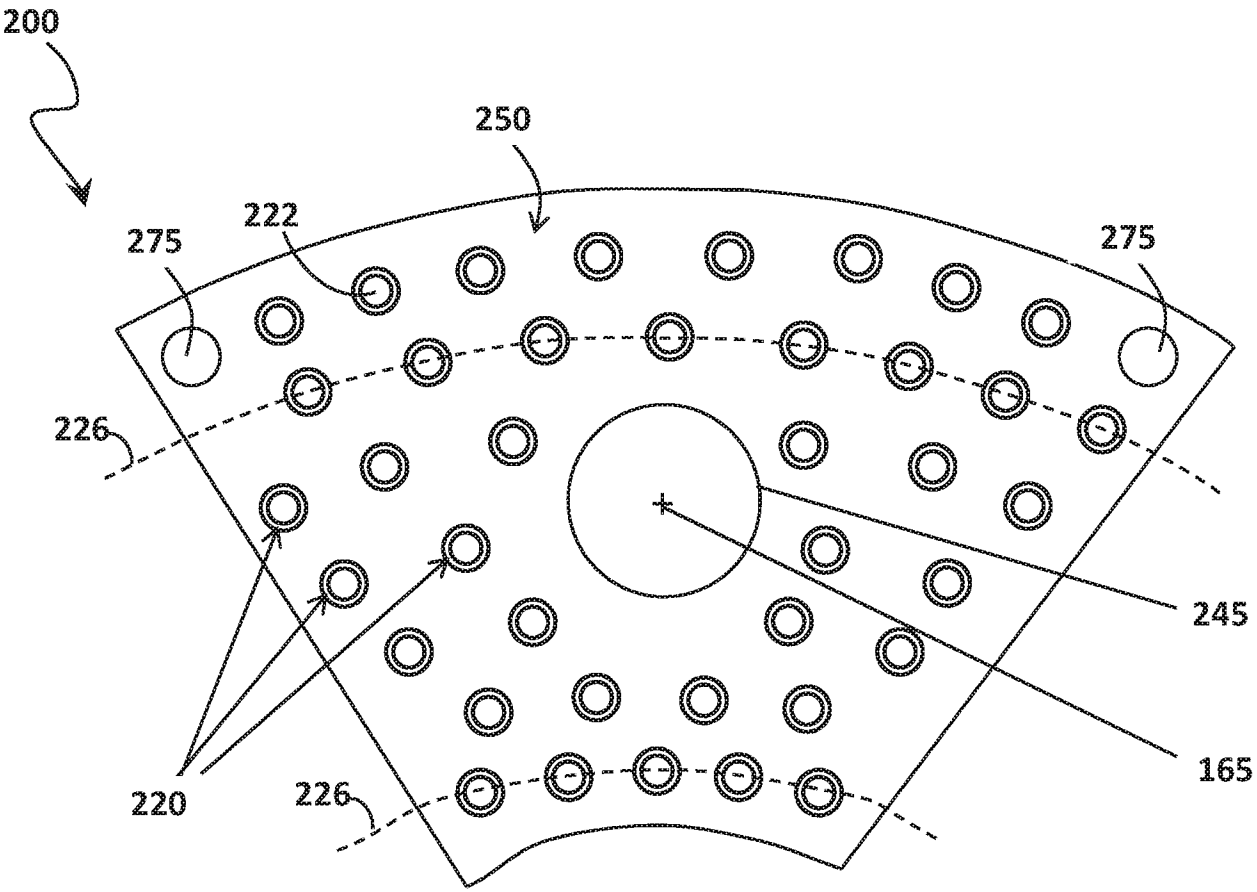
-- FIG. 6 --

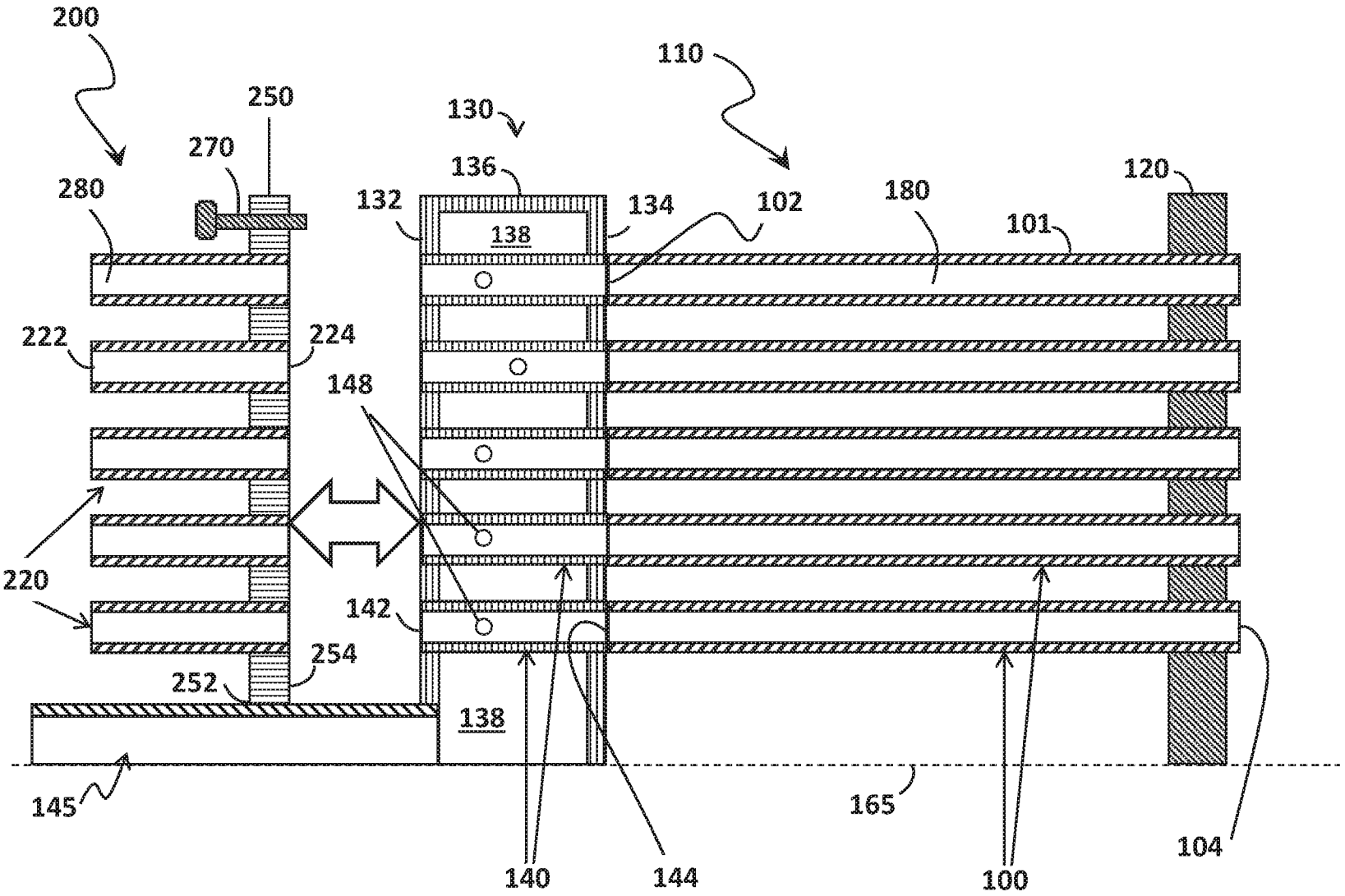
-- FIG. 7 --

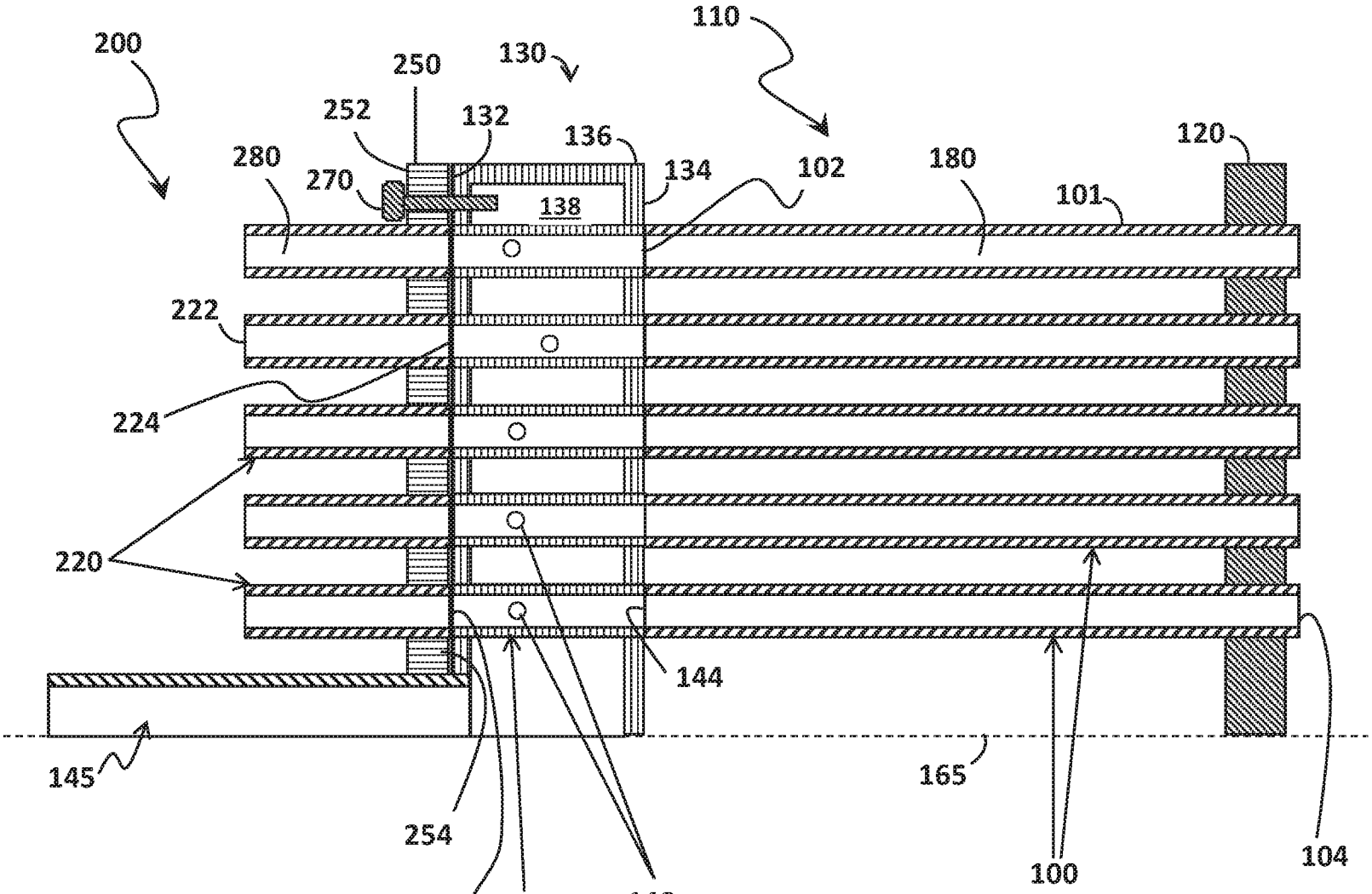
-- FIG. 8 --

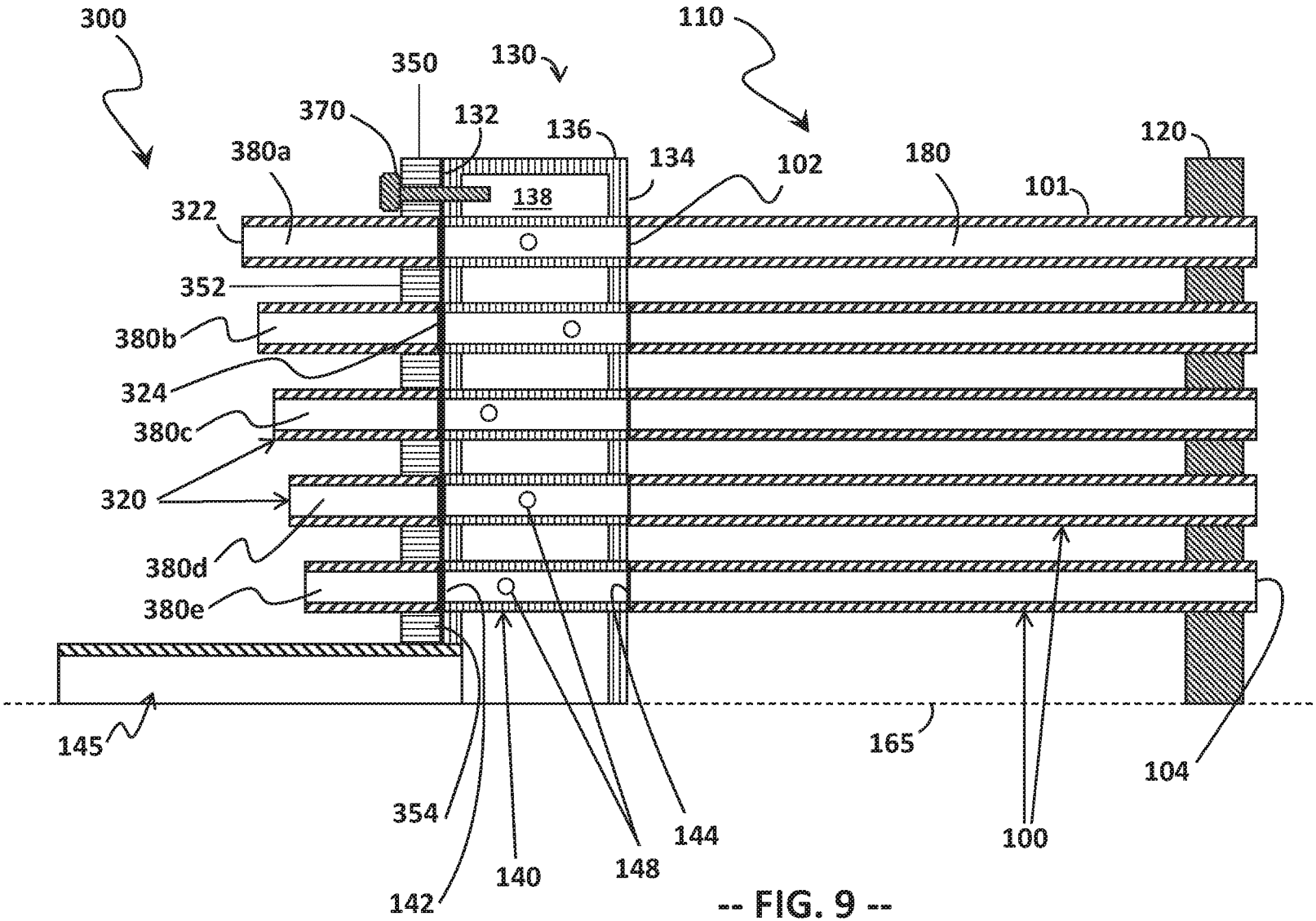
-- FIG. 9 --

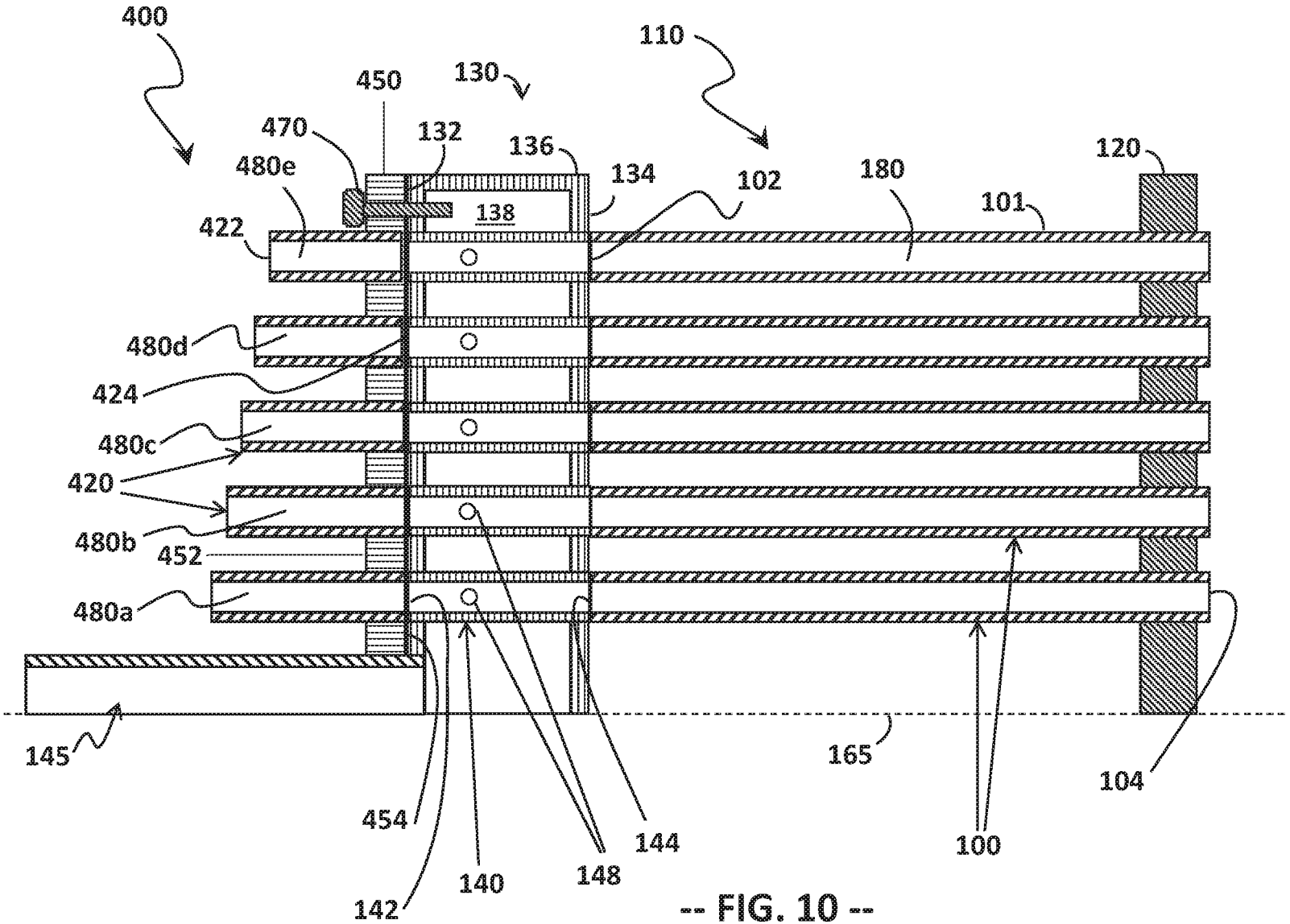
-- FIG. 10 --

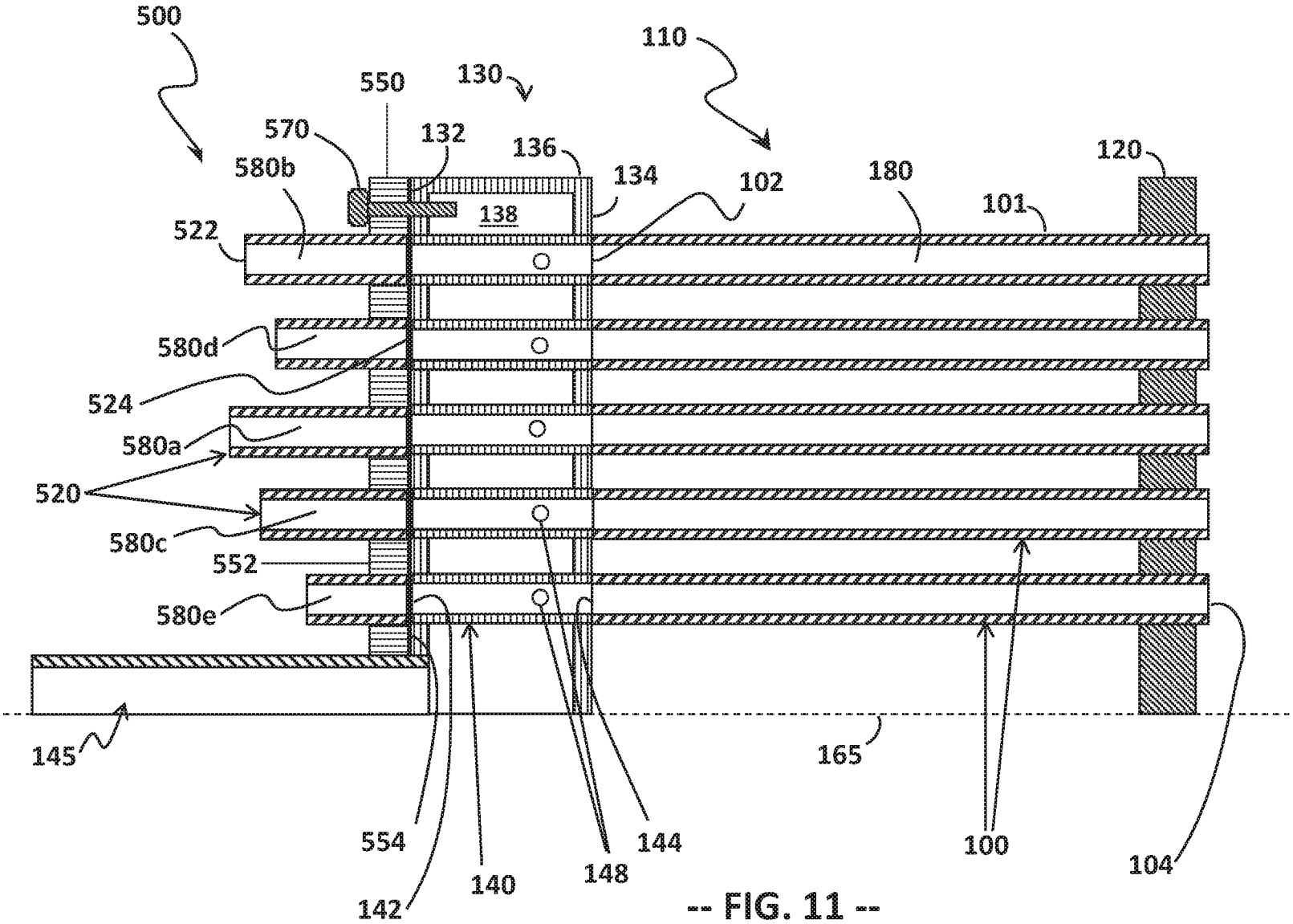
-- FIG. 11 --

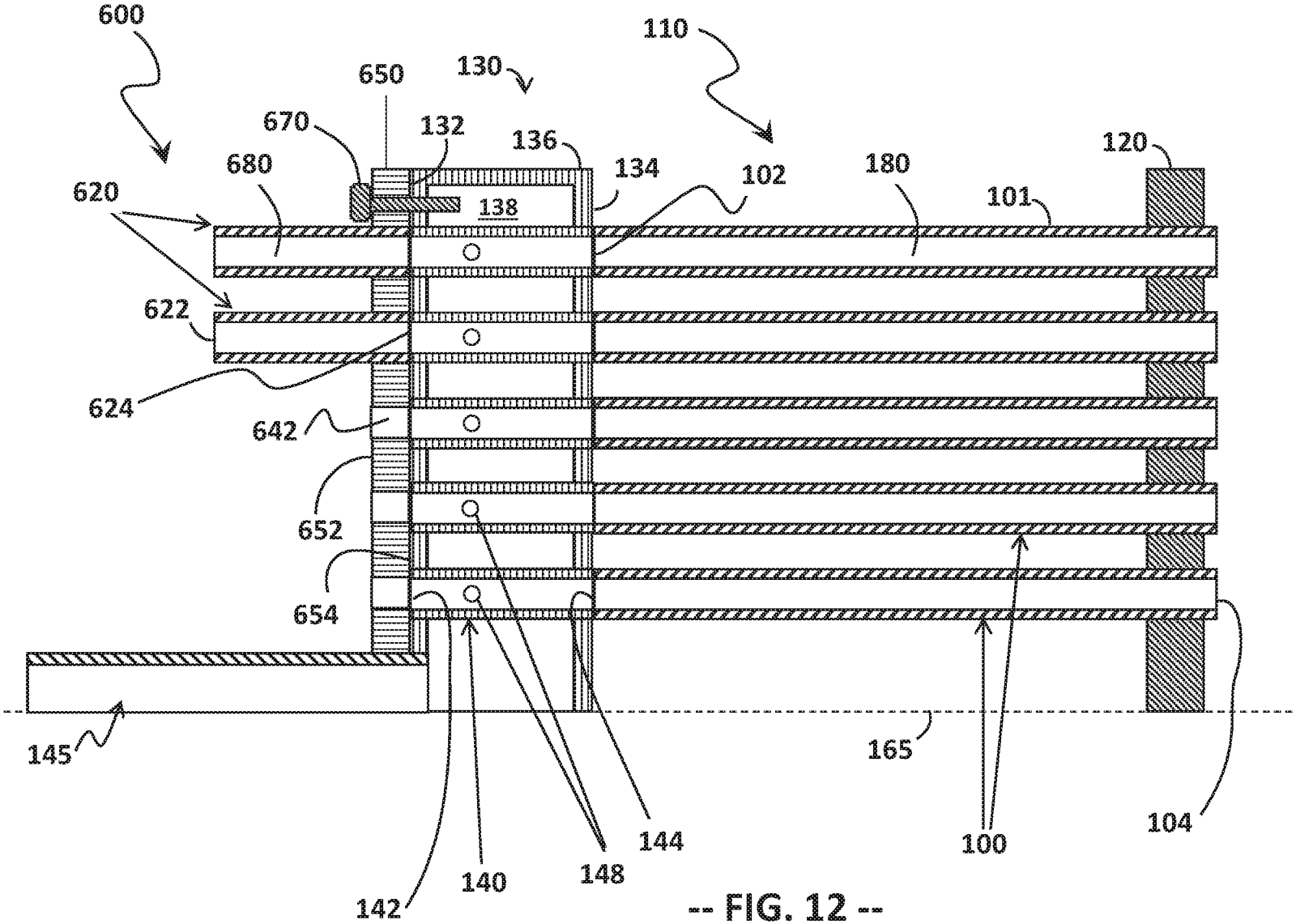
-- FIG. 12 --

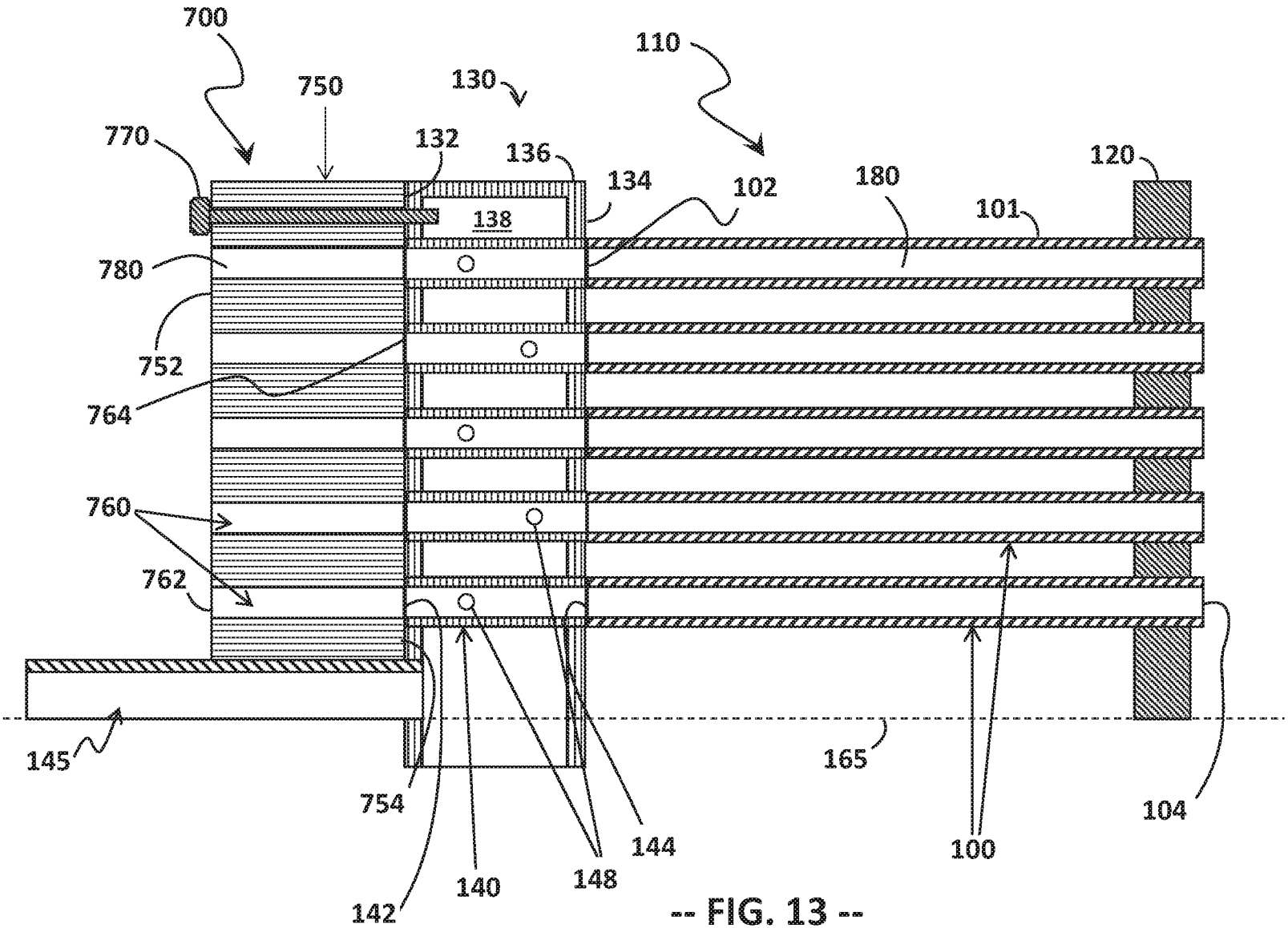
-- FIG. 13 --

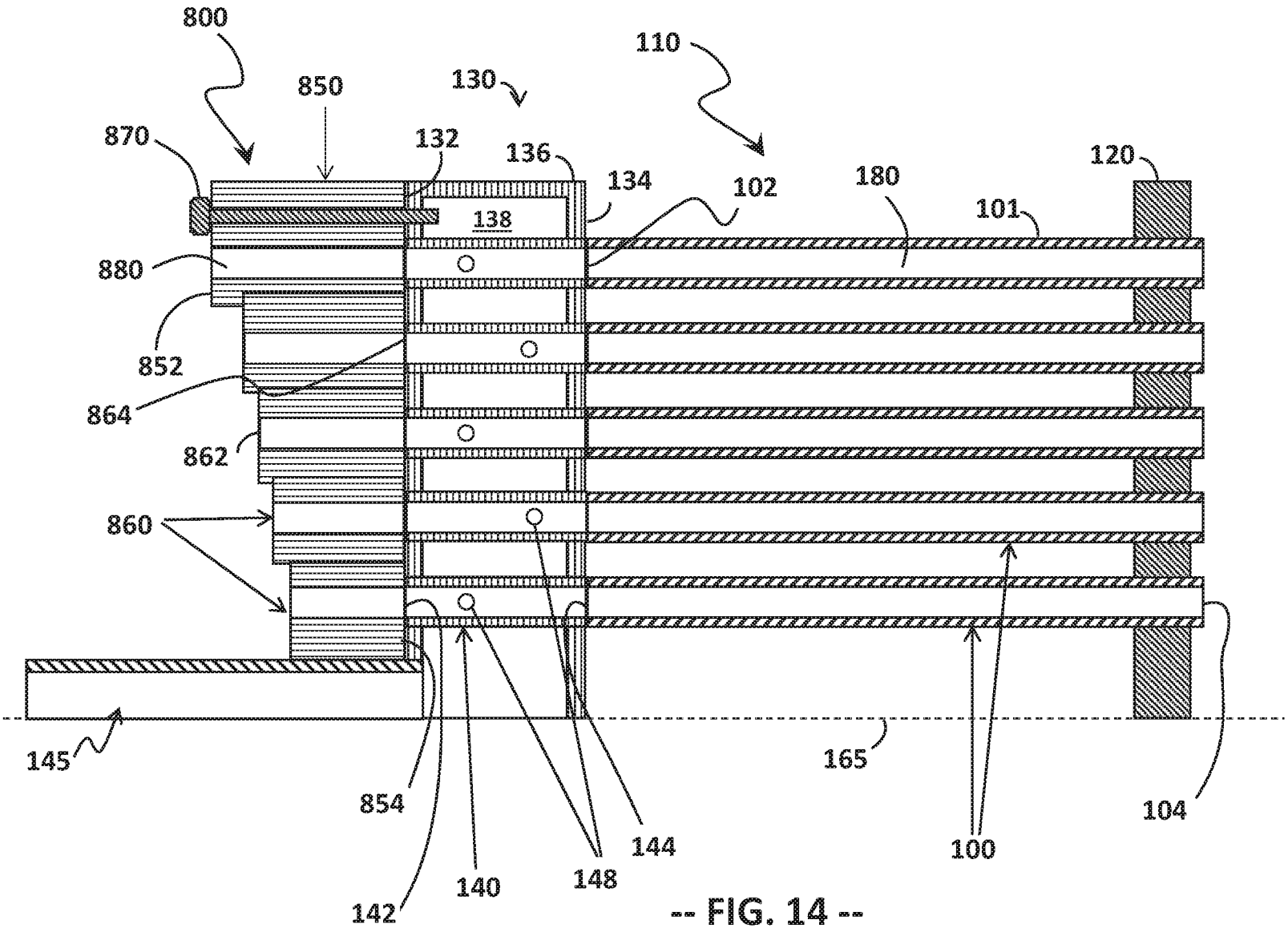
-- FIG. 14 --

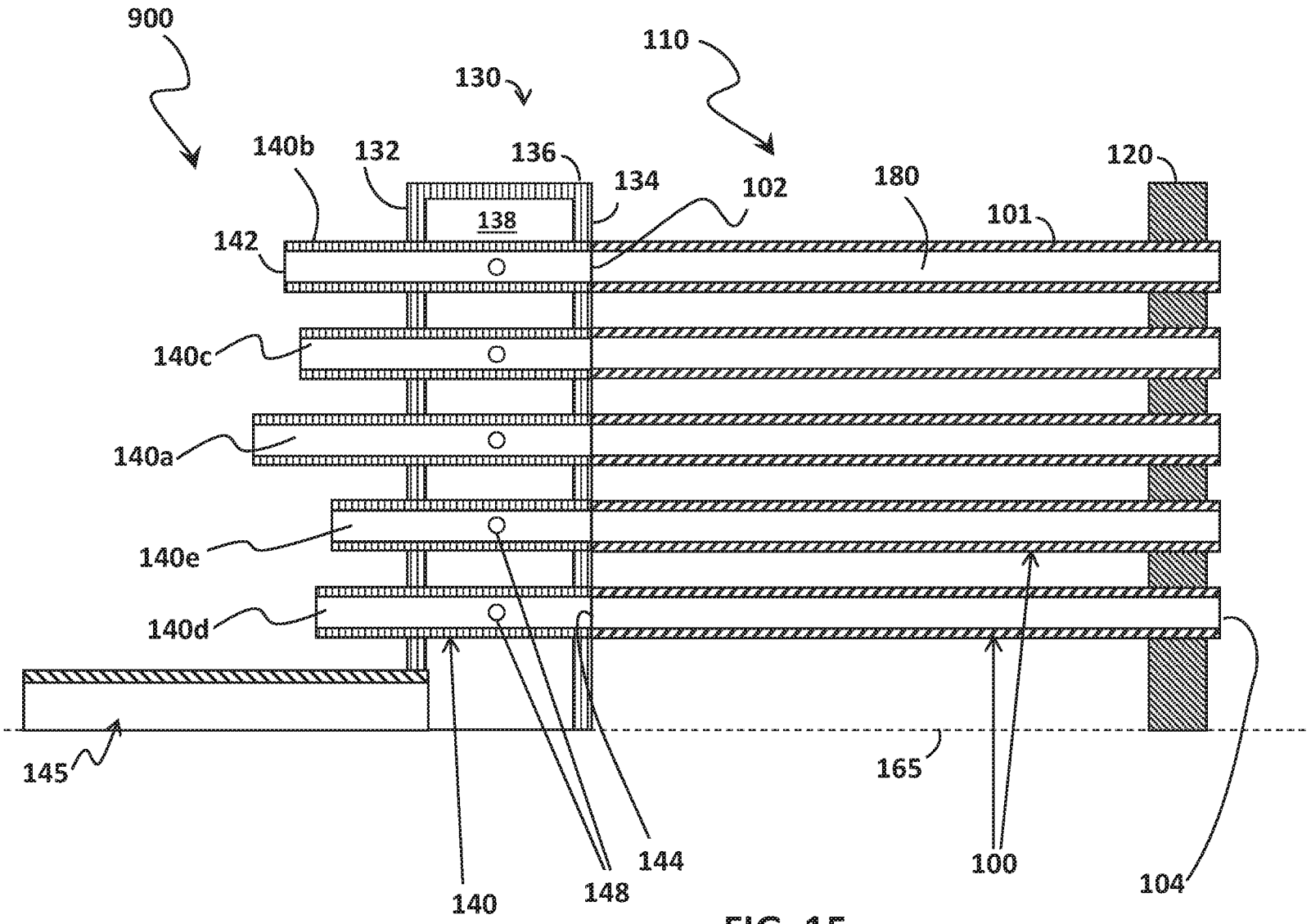
-- FIG. 15 --

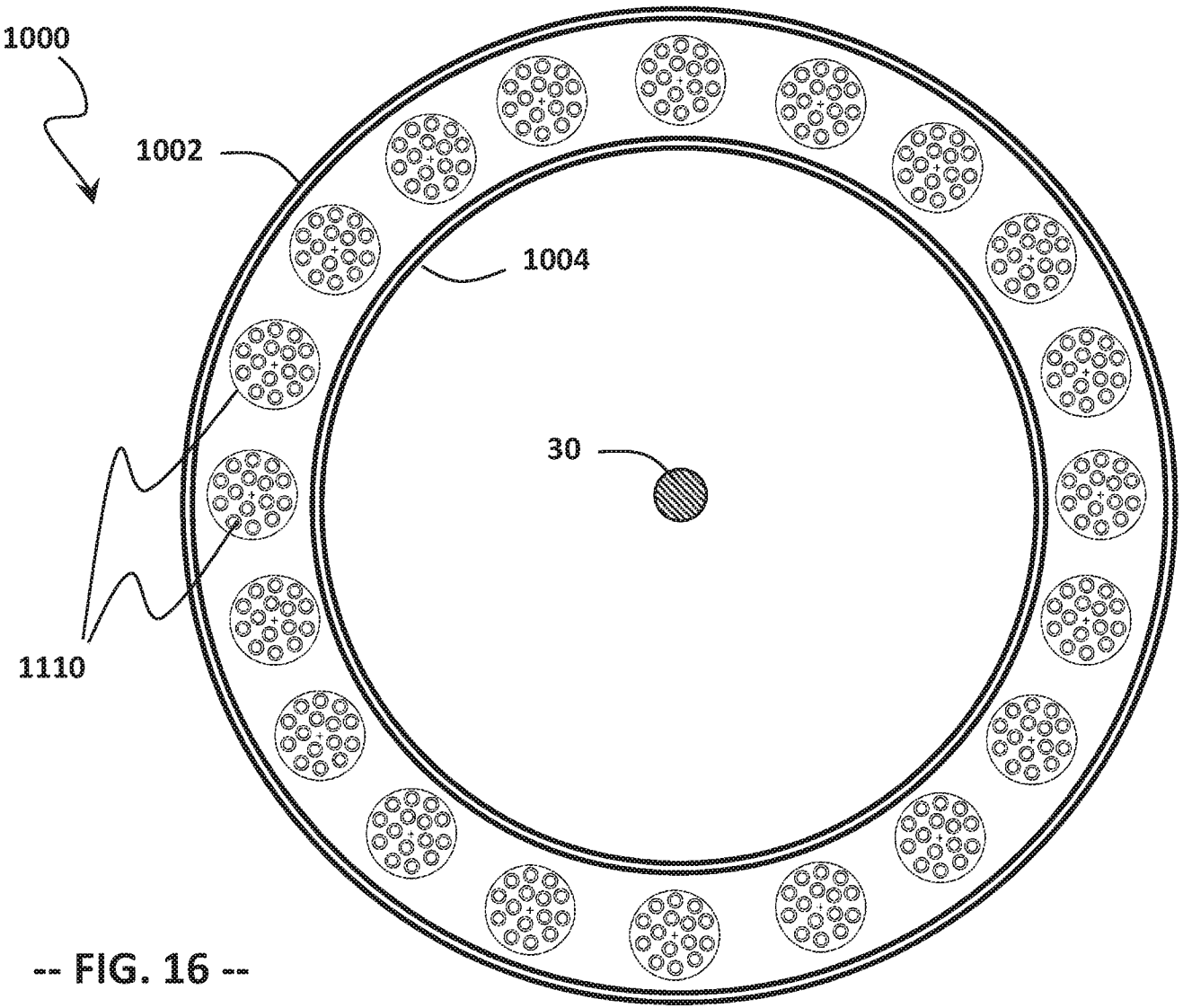
-- FIG. 16 --

DYNAMICS-MITIGATING ADAPTER FOR BUNDLED TUBE FUEL NOZZLE

TECHNICAL FIELD

The present disclosure is directed to a gas turbine combustor having a bundled tube fuel nozzle and, more specifically, to an adapter removably attached to the bundled tube fuel nozzle for mitigating combustion dynamics.

BACKGROUND

A gas turbine generally includes a compressor section, a combustion section having a combustor, and a turbine section. The compressor section progressively increases the pressure of the working fluid to supply a compressed working fluid to the combustion section. The compressed working fluid is routed through one or more fuel nozzles that extend axially within a forward, or head, end of the combustor. A fuel is combined with the flow of the compressed working fluid to form a combustible mixture. The combustible mixture is burned within a combustion chamber to generate combustion gases having a high temperature, pressure, and velocity. The combustion chamber is defined by one or more liners or ducts that define a hot gas path through which the combustion gases are conveyed into the turbine section. In a can-annular type combustion system, multiple combustion cans (each having its own fuel nozzle(s) and liner) produce combustion gases that drive the turbine section.

The combustion gases expand as they flow through the turbine section to produce work. For example, expansion of the combustion gases in the turbine section may rotate a shaft connected to a generator to produce electricity. The turbine may also drive the compressor by means of a common shaft or rotor.

In some combustion systems, the fuel nozzles are bundled tube fuel nozzles that include a plurality of parallel mixing tubes within a common shroud or housing. The mixing tubes extend between an upstream plate and a downstream plate, such that a fuel plenum is defined by the housing, the upstream plate, and the downstream plate. The mixing tubes have an inlet defined through the upstream plate, an outlet defined through the downstream plate, and one or more fuel injection ports defined through the mixing tube itself between the upstream plate and the downstream plate. The one or more fuel injection ports is in fluid communication with the fuel plenum, such that fuel from the fuel plenum flows through the one or more fuel injection ports and into the interior of the mixing tubes where the fuel is mixed with air introduced via the tube inlet. The fuel and air mix within the tube, and a fuel/air mixture is delivered through the outlet of the tube and into the combustion zone.

Under some conditions, bundled tube fuel nozzles have exhibited combustion dynamics that are in-phase with the resonant tones of the combustor. Thus, a readily adaptable device for mitigating such combustion dynamics is desirable.

SUMMARY

According to a first aspect of the present disclosure, an adapter for mitigating dynamics in a bundled tube fuel nozzle includes a mounting body defining at least one flow passage aligned with an inlet of at least one tube of a plurality of tubes of the bundled tube fuel nozzle. The at least one flow passage extends an axial length of the at least one tube of the plurality of tubes.

In accordance with the first aspect, the adapter includes at least one extender affixed to and extending upstream of the mounting body, the at least one extender defining the at least one flow passage. Further, the at least one extender is one of a plurality of extenders affixed to and extending upstream of the mounting body, such that a respective extender extends the axial length of each tube of the plurality of tubes. In another variation, the mounting body is a monolithic unit, and the at least one flow passage is defined through the mounting body, such that the mounting body defines an entire length of the at least one flow passage.

According to a second aspect of the present disclosure, a bundled tube fuel nozzle includes an upstream plate, a downstream plate, and a housing extending between the upstream plate and the downstream plate, such that a fuel plenum is defined at least partially by the upstream plate, the downstream plate, and the housing. A plurality of tubes extends in parallel between the upstream plate and the downstream plate. Each tube has an inlet defined through the upstream plate, an outlet defined through the downstream plate, and at least one fuel injection port defined through the tube in fluid communication with the fuel plenum. An adapter, which is removably coupled to the upstream plate, includes a mounting body defining at least one flow passage aligned with the inlet of at least one tube to extend an axial length of the at least one tube of the plurality of tubes.

In accordance with the second aspect, the adapter includes at least one extender affixed to and extending upstream of the mounting body, the at least one extender defining the at least one flow passage. Further, the at least one extender is one of a plurality of extenders affixed to and extending upstream of the mounting body. In an exemplary embodiment, the plurality of extenders defines a first length, which is common to each extender of the plurality of extenders. In another embodiment, the plurality of extenders includes at least one extender defining a first length and at least one extender defining a second length different from the first length. In at least one configuration, the tube extender defining the first length is proximate a centerline of the fuel nozzle, while the tube extender defining the second length is distal to the centerline of the fuel nozzle. In this configuration, the first length may be shorter than the second length. Alternately, the first length may be longer than the second length.

The plurality of tubes may comprise a first portion disposed along a radially outer perimeter of the fuel nozzle and a second portion of tubes, and a plurality of extenders may be in fluid communication with the first portion of tubes. In this arrangement, the mounting body defines apertures therethrough, the apertures being aligned with the inlets of the second portion of tubes.

In another variation, the mounting body is a monolithic unit, and the at least one flow passage is defined through the mounting body, such that the mounting body defines an entire length of the at least one flow passage.

According to a third aspect of the present disclosure, a combustor for a gas turbine includes a plurality of bundled tube fuel nozzles disposed in an annular array about a centerline of the combustor. Each bundled tube fuel nozzle includes an upstream plate, a downstream plate, and a housing extending between the upstream plate and the downstream plate, such that a fuel plenum is defined at least partially by the upstream plate, the downstream plate, and the housing. A plurality of tubes extends in parallel between the upstream plate and the downstream plate. Each tube has an inlet defined through the upstream plate, an outlet defined through the downstream plate, and at least one fuel injection port defined through the tube in fluid communication with the fuel plenum. An adapter, which is removably coupled to the upstream plate of at least one of the bundled tube fuel nozzles, includes a mounting body defining at least one flow passage aligned with the inlet of at least one tube to extend an axial length of the at least one tube of the plurality of tubes.

In accordance with the third aspect, the adapter includes at least one extender affixed to and extending upstream of the mounting body, the at least one extender defining the at least one flow passage. In another variation, the mounting body is a monolithic unit, and the at least one flow passage is defined through the mounting body, such that the mounting body defines an entire length of the at least one flow passage.

Further, the adapter coupled to at least one of the bundled tube fuel nozzles is one of a plurality of adapters, each adapter of the plurality of adapters being removably coupled to a respective bundled tube fuel nozzle of the plurality of bundled tube fuel nozzles. In one specific embodiment, each adapter of the plurality of adapters is identical.

In yet another assembly, the plurality of tubes in each bundled tube fuel nozzle of the plurality of bundled tube fuel nozzles may include a first portion disposed along a radially outer perimeter of the respective bundled tube fuel nozzle and a second portion of tubes, and a plurality of extenders may be in fluid communication with the first portion of tubes. In this arrangement, the mounting body defines apertures therethrough, the apertures being aligned with the inlets of the second portion of tubes.

BRIEF DESCRIPTION OF THE DRAWINGS

A full and enabling disclosure of the present products and methods, including the best mode thereof, directed to one of ordinary skill in the art, is set forth in the specification, which refers to the appended figures, in which:

FIG. 1 is a schematic illustration of a power-generating gas turbine assembly, as may employ the present bundled tube fuel nozzles and tube inlet extension assemblies described herein;

FIG. 2 is a simplified side cross-sectional view of a combustor of the gas turbine of FIG. 1;

FIG. 3 is a plan view of a cap assembly of the combustor of FIG. 2, as viewed from the aft end of the combustor looking upstream, according to a first aspect herein;

FIG. 4 is a plan view of an alternate cap assembly of the combustor of FIG. 2, as viewed from the aft end of the combustor looking upstream, according to a second aspect herein FIG. 5 is a perspective view of a bundled tube fuel nozzle having an attached adapter, according to one aspect of the present disclosure;

FIG. 6 is an upstream plan view of the adapter of FIG. 5;

FIG. 7 is a schematic representation of the bundled tube fuel nozzle of FIG. 5 and a first adapter separate from the bundled tube fuel nozzle, according to a first aspect of the present disclosure;

FIG. 8 is a schematic representation of a partial cross-section of the bundled tube fuel nozzle of FIG. 7 and the adapter of FIG. 7 in an assembled arrangement;

FIG. 9 is a schematic representation of a partial cross-section of the bundled tube fuel nozzle (as in FIG. 7) and a second adapter, according to a second aspect of the present disclosure;

FIG. 10 is a schematic representation of a partial cross-section of the bundled tube fuel nozzle (as in FIG. 7) and a third adapter, according to a third aspect of the present disclosure;

FIG. 11 is a schematic representation of a partial cross-section of the bundled tube fuel nozzle (as in FIG. 7) and a fourth adapter, according to a fourth aspect of the present disclosure;

FIG. 12 is a schematic representation of a partial cross-section of the bundled tube fuel nozzle (as in FIG. 7) and a fifth adapter, according to a fifth aspect of the present disclosure;

FIG. 13 is a schematic representation of a partial cross-section of the bundled tube fuel nozzle (as in FIG. 7) and a sixth adapter, according to a sixth aspect of the present disclosure;

FIG. 14 is a schematic representation of a partial cross-section of the bundled tube fuel nozzle (as in FIG. 7) and a seventh adapter, according to a seventh aspect of the present disclosure;

FIG. 15 is a schematic representation of a partial cross-section of the bundled tube fuel nozzle (as in FIG. 7), in which the adapter is integral with a fuel plenum portion of the bundled tube fuel nozzle; and FIG. 16 is a cross-sectional view of an annular combustion system, as viewed from the aft end looking upstream, which may be used in the gas turbine of FIG. 1 and which may include the bundled tube fuel nozzles and adapters of any of FIGS. 7 through 15.

DETAILED DESCRIPTION

The following detailed description illustrates a gas turbine combustor, a bundled tube fuel nozzle for delivering a fuel/air mixture to a combustion zone of the gas turbine combustor, and various adapters for mitigating dynamics in the bundled tube fuel nozzle, by way of example and not limitation. The description enables one of ordinary skill in the art to make and use the adapters and the bundled tube fuel nozzle. The description includes what is presently believed to be the best modes of making and using the present adapters. An exemplary bundled tube fuel nozzle having a dynamics-mitigating adapter is described herein as being coupled to a combustor of a heavy-duty gas turbine assembly used for electrical power generation. However, it is contemplated that the bundled tube fuel nozzle with adapter described herein may have general application to a broad range of systems in a variety of fields other than electrical power generation.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

The term "radially" refers to the relative direction that is substantially perpendicular to an axial centerline of a particular component, and the term "axially" refers to the relative direction that is substantially parallel to an axial centerline of a particular component. As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the term "circumference" (or any variation thereof) refers to a dimension extending around a center of any suitable shape (e.g., a square, a rectangle, a triangle, etc.) and is not limited to a dimension extending around a center of a circular shape.

Each example is provided by way of explanation, not limitation of the invention. In fact, it will be apparent to those skilled in the art that modifications and variations can be made in the present adapter and/or bundled tube fuel nozzle, without departing from the scope or spirit of the present disclosure. For instance, features illustrated or described as part of one embodiment may be used on another embodiment to yield a still further embodiment. Thus, it is intended that the present disclosure encompasses such modifications and variations as fall within the scope of the appended claims and their equivalents.

Although exemplary embodiments of the present bundled tube fuel nozzle and adapter will be described generally in the context of a combustor incorporated into a gas turbine for purposes of illustration, one of ordinary skill in the art will readily appreciate that embodiments of the present disclosure may be applied to any combustor incorporated into any turbomachine and is not limited to a gas turbine combustor, unless specifically recited in the claims.

Reference will now be made in detail to various embodiments of the present bundled tube fuel nozzle and adapter, examples of which are illustrated in the accompanying drawings. The detailed description uses numerical and letter designations to refer to features in the drawings. Like or similar designations in the drawings and description have been used to refer to like or similar parts.

FIG. 1 provides a functional block diagram of an exemplary gas turbine 10 that may incorporate various embodiments of the present disclosure. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section having a compressor 16 where the working fluid 14 passes through multiple stages of stationary vanes and rotating blades, which progressively impart kinetic energy to the working fluid 14 to produce a compressed working fluid 18.

The compressed working fluid 18 is directed through a compressor discharge casing 72 that defines a compressor discharge plenum 70 (FIG. 2). The compressor working fluid (e.g., air) 18 flows into one or more combustors 24 and is mixed with a fuel 20 from a fuel supply system (not shown) to form a combustible mixture within one or more combustors 24. The combustible mixture is burned to produce combustion gases 26 having a high temperature, pressure, and velocity. The combustion gases 26 flow through a turbine 28 of a turbine section, where multiple stages of stationary nozzles and rotating blades cause the combustion gases 26 to expand to produce work.

For example, the turbine 28 may be connected to a shaft 30 so that rotation of the turbine 28 drives the compressor 16 to produce the compressed working fluid 18. Alternately or in addition, the shaft 30 may connect the turbine 28 to a load 32, such as a generator for producing electricity.

Exhaust gases 34 from the turbine 28 flow through an exhaust section (not shown) that connects the turbine 28 to an exhaust stack downstream from the turbine. The exhaust section may include, for example, a heat recovery steam generator (not shown) for cleaning and extracting additional heat from the exhaust gases 34 prior to release to the environment. The heat recovery steam generator, in turn, may be coupled to a steam turbine as part of a combined cycle power plant.

The combustors 24 may be any type of combustor known in the art, and the present invention is not limited to any particular combustor design unless specifically recited in the claims. For example, the combustor 24 may be a can type (sometime called a can-annular type) of combustor, as shown in FIG. 2, or may be an annular combustor, as shown in FIG. 16.

FIG. 2 is a schematic simplified side cross-section of a combustor, or combustion can, 24, as may be included in a can-annular combustion system for the heavy-duty gas turbine 10. In a can-annular combustion system, a plurality of combustion cans 24 (e.g., 8, 10, 12, 14, 16, or more) are positioned in an annular array about the shaft 30 that connects the compressor 16 to the turbine 28.

As shown in FIG. 2, the combustion can 24 includes a liner 62 that contains and conveys combustion gases 26 to the turbine. The liner 62 defines a combustion chamber 60 within which combustion occurs. The liner 62 may have a cylindrical liner portion upstream of a tapered transition piece 64 that is separate from the cylindrical liner portion, as in many conventional combustion systems. Alternately, the liner 62 and the transition piece 64 may be integrated with one another to form a unified body (or "unibody") construction. Thus, any discussion of the liner 62 herein is intended to encompass both conventional combustion systems having a separate liner 62 and transition piece 64 and those combustion systems having a unibody liner (not shown). Moreover, the present disclosure is equally applicable to those combustion systems in which the transition piece 64 and the stage one nozzle 80 of the turbine 28 are integrated into a single unit, sometimes referred to as a "transition nozzle" or an "integrated exit piece."

The liner 62 may be surrounded by an outer sleeve 66, which is spaced radially outward of the liner 62 to define an annulus 67 between the liner 62 and the outer sleeve 66. The outer sleeve 66 may include a flow sleeve portion at the forward end and an impingement sleeve portion at the aft end, as in many conventional combustion systems. Alternately, the outer sleeve 66 may have a unified body (or "unisleeve") construction, in which the flow sleeve portion and the impingement sleeve portion are integrated with one another in the axial direction. As before, any discussion of the outer sleeve 66 herein is intended to encompass both convention combustion systems having a separate flow sleeve and impingement sleeve and combustion systems having a unisleeve outer sleeve.

The head end portion 40 of the combustion can 24 is at least partially surrounded by a forward casing 42, which is physically coupled and fluidly connected to the compressor discharge casing 72, and an end cover 46 that extends radially across at least a portion of each combustor 24. The end cover 46 provides an interface for supplying fuel, diluent, and/or other additives to each combustor 24. In addition, the combustor casing 42 and the end cover 46 may combine to at least partially define a head end 40 inside each combustor 24. The fuel nozzles 44 may be radially arranged in a cap assembly 50 that extends radially across at least a portion of each combustor 24 downstream from the head end 40.

The compressor discharge casing 72 is fluidly connected to an outlet of the compressor 16 and defines the pressurized compressor discharge plenum 70 that surrounds at least a portion of the combustion can 24. Air 18 flows from the compressor discharge casing 72 into the annulus 67 at an aft end of the combustion can, via openings 68 (e.g., impingement holes) defined in the outer sleeve 66. Air 18 flows along the outside of the transition piece 64 and the liner 62 to provide convective cooling to the transition piece 64 and the liner 62.

Because the annulus 67 is fluidly coupled to the head end portion 40, the air flow 18 travels upstream from the aft end of the combustion can 24 to the head end air plenum, where the air flow 18 reverses direction and enters the fuel nozzles 44 (also fuel nozzles 45, 110, and/or 115, as shown in FIGS. 3 and 4). The fuel nozzles 44 (45, 110, and/or 115) provide fluid communication for the working fluid 17 to flow, as part of a mixture with fuel 20, through the cap assembly 50 and into the combustion chamber 60.

FIGS. 3 and 4 are plan views of alternate embodiments of the combustor cap assembly 50, as viewed from an aft end of the combustor 24 looking in an upstream direction. The cap assembly 50 illustrated in FIG. 2 corresponds to that shown in more detail in FIG. 3, although it should be understood that the cap assembly 50 illustrated in FIG. 4 is equally well-suited for the combustor 24 shown in FIG. 2.

In FIG. 3, a center fuel nozzle 45, which is disposed about a centerline 65 of the combustor 24, is secured within a respective opening (not separately labeled) in a cap plate 52. A plurality (in this example, six) outer fuel nozzles 44 are disposed about the center fuel nozzle 45 and likewise are secured within respective openings in the cap plate 52. Each outer fuel nozzle 45 has a centerline 165. Each fuel nozzle 44, 45 is a bundled tube fuel nozzle having a plurality of parallel, non-concentric mixing tubes 100 that extend through a common fuel plenum (as shown in FIG. 7 and discussed below). The cap plate 52 may include a plurality of cooling holes to facilitate cooling of the cap face, and/or the cap assembly 50 may include a second plate upstream of the cap plate 52 to direct cooling flow against the upstream surface of the cap plate 52.

In FIG. 4, a center fuel nozzle 115 is surrounded by a plurality (in this case, six) outer fuel nozzles 110. Each outer fuel nozzle 110 has a truncated wedge shape, such that the outer fuel nozzles 110 may be positioned in close proximity to the center fuel nozzle 115 and cover a majority of the head end area. The truncated wedge shape may be defined as having a pair of radial sides 112 that extend in opposite directions and that are joined by a first (radially inner) arcuate side 114 and a second (radially outer) arcuate side 116. The radially outer sides 116 define a radially outer perimeter of the fuel nozzles 110 and, collectively, of the cap assembly 50. Each fuel nozzle 110 has a respective centerline 165 radially outward of the centerline 65 of the fuel nozzle 115 and the combustor 24. In this exemplary configuration, each fuel nozzle 110, 115 may have its own respective nozzle face 120 in a shape corresponding to the shape of the fuel nozzle 110 (wedge) or 115 (round).

Alternately, the tubes 100 that are part of each respective fuel nozzle 110, 115 may extend through a common cap plate (not shown). In this configuration, the fuel nozzles 110 have respective fuel plenums defining a wedge shape, and the fuel nozzle 115 has a fuel plenum defining a round shape. The upstream ends of the mixing tubes 100 of each fuel nozzle 110, 115 extend through a respective fuel plenum for each fuel nozzle 110, 115.

It should be noted that the specific size, spacing, and number of mixing tubes 100 shown in the Figures (including FIGS. 3 and 4) is intended to be representative of the present bundled tube fuel nozzles 44, 45, 110, 115 and should not be construed as limiting the present bundled tube fuel nozzles as having tubes of any particular size, spacing, or number. Moreover, it should be not construed as limiting the present bundled tube fuel nozzles as having tubes with a single tube diameter.

FIG. 5 illustrates the bundled tube fuel nozzle 110 having an adapter 200, according to one aspect of the present disclosure. The bundled tube fuel nozzle 110 includes a fuel plenum portion 130 through which and from which a plurality of mixing tubes 100 extend, as explained in more detail below. The fuel plenum portion 130 is in fluid communication with a fuel supply line 145, which, in the embodiment shown, is disposed along the centerline 165 of the fuel nozzle 110. The downstream ends of the mixing tubes 100 project through a nozzle face 120 or, alternately, a portion of a full cap face.

The adapter 200 includes a mounting body 250 that is removably secured to the fuel plenum portion 130 via threaded bolts 270 or other removable joining means. A plurality of extenders 220 are joined to and project upstream from the mounting body 250. Each extender 220 defines a flow passage from an inlet end 222 to an outlet end 224 (shown in FIG. 7) adjacent the fuel plenum portion 130. Each extender 220 is aligned with a respective mixing tube 100, such that the flow passage of the mixing tube 100 is lengthened, thereby reducing the occurrence of combustion dynamics.

FIG. 6 provides a plan view of an upstream face of the adapter 200. As discussed above, the adapter 200 includes a plurality of extenders 220 arranged generally in rows (e.g., rows 226) about the centerline 165, each extender 200 having the inlet end 222. The mounting body 250 defines an opening 245 therethrough that surrounds the centerline 165 of the fuel nozzle 110 to accommodate the fuel supply line 145. In addition, the mounting body 250 includes mounting bores 275 to facilitate mounting the adapter 200 to the bundled tube fuel nozzle 110. Two mounting bores 275 are shown in opposite corners, although different numbers of mounting bores 275 may be used instead.

FIGS. 7 through 15 schematically illustrate various configurations for the adapter 200. It should be understood that any of the exemplary adapters is suitable for installation with the bundled tube fuel nozzle 110 for use in the cap assembly 50 (shown in FIGS. 3 and 4), the combustor 24 (shown in FIGS. 2 and 16), and the gas turbine (shown in FIG. 1).

FIG. 7 illustrates the adapter 200 aligned with the bundled tube fuel nozzle 110, either as ready for assembly or immediately following disassembly. The adapter 200 includes the mounting body 250, which has an upstream surface 252 and a downstream surface 254. Each extender 220 is joined to the mounting body 250 and projects from the upstream surface 252 thereof, such that a flow passage 280 is defined through the extender 220 from the inlet 222 to the outlet 224. A bolt 270, or other fastener removable with hand tools, is disposed at a location radially outward of the center line 165 of the fuel nozzle 110.

The bundled tube fuel nozzle 110 includes the fuel plenum portion 130. A fuel plenum 138 is defined by an upstream plate 132, a downstream plate 134, and a housing 136 that extends axially and circumferentially between the upstream plate 132 and the downstream plate 134. The fuel supply line 145 is in fluid communication with the fuel plenum 138.

Mixing tubes 100 extend through and downstream of the fuel plenum 138. Each mixing tube 100 has a fuel injection segment 140 that is surrounded by the fuel plenum 138. The fuel injection segments 140 extend from the upstream plate 132 to the downstream plate 134 of the fuel plenum portion 130. Each fuel injection segment 140 includes an inlet 142 defined through the upstream plate 132, an outlet 144 defined through the downstream plate 134, and one or more fuel injection ports 148 in fluid communication with the fuel plenum 138. The fuel injection ports 148 may be located in a single axial plane or in multiple axial planes.

If desired, the fuel plenum portion 130, including the fuel injection segments 140, may be produced by additive manufacturing, such as direct metal laser melting, such that the fuel plenum portion 130 is a unitary body. Alternately, conventional manufacturing means may be used to assemble the individual components into the fuel plenum portion 130.

The mixing tubes 100 have a downstream mixing segment 101 having an inlet end 102 and an outlet end 104. The inlet end 102 abuts and is aligned with the outlet end 144 of a corresponding fuel injection segment 140. The outlet end 104 extends to or through the nozzle face 120. A single flow passage is defined through each mixing tube 100 from the inlet 142 of the fuel injection segment 140, through the outlet 144 of the fuel injection segment, through the inlet 102 of the downstream segment, and through the outlet 104 of the downstream segment. The length of the fuel injection segment 140 may be based on the volume of fuel flow to be supplied to the combustion zone 60, and the overall length of each mixing tube 100 may be based on the desired residence time (tau) of the fuel and air within the mixing tube 100 to produce an expected level of mixedness.

FIG. 8 illustrates the adapter 200 removably secured to the bundled tube fuel nozzle 110, via one or more removable fasteners 270, such as bolts. A socket or threaded passage (not shown) for receiving the fastener 270 may be incorporated or printed into the fuel plenum portion 130. When the adapter 200 is installed, the downstream surface 254 of the mounting body 250 contacts the upstream plate 132 of the fuel plenum portion 130, such that the outlets 224 of the extenders 220 are aligned with the inlets 142 of the fuel injection segments 140 of the mixing tubes 100. In this manner, the length of the flow passage 180 through the mixing tube 100 is increased by the length of the flow passage 280 through the extender 220.

It has been found that combustion dynamics may be reduced when the flow passages 180 are extended upstream of the fuel injection ports 148 for at least one, some portion of, or all the mixing tubes 100 in a given fuel nozzle 110. The extension of the flow passage length changes the acoustic pressure oscillations within the mixing tube 100, but not change the residence time of the fuel/air mixture within the mixing tube 100. Modifying the mode shape of the acoustic pressure oscillations of the mixing tubes 100 causes the acoustic pressure oscillations to be out-of-phase with resonance modes of the combustors 24 (or the combustor 1000, shown in FIG. 16). The present adapters (e.g., 200), as disclosed herein, provide an effective and easy means of extending the flow passage(s) 180 of the bundled tube fuel nozzle 110.

Moreover, the adapter (e.g., 200) may be used on a single fuel nozzle 110, on all the fuel nozzles 110 in the combustor cap assembly 50, on alternating fuel nozzles 110 in the combustor cap assembly 50, or on one or more (but not all) fuel nozzles 110 in the combustor cap assembly 50. Further, the adapters (e.g., 200) may all have the same configuration or may have different configurations, such as one or more of those illustrated in FIGS. 7 through 15. The bundled tube fuel nozzle 110 shown in FIGS. 9 through 15 is described above and, thus, for the sake of expediency, is not described again with respect to each Figure.

FIG. 9 illustrates an adapter 300 that includes a mounting body 350, which has an upstream surface 352 and a downstream surface 354. Each extender 320 is joined to the mounting body 350 and projects from the upstream surface 352 thereof, such that a flow passage 380 is defined through the extender 320 from the inlet 322 to the outlet 324. A bolt 370, or other fastener removable with hand tools, is disposed at a location radially outward of the center line 165 of the fuel nozzle 110 and secures the adapter 400 to the bundled tube fuel nozzle 110.

In this configuration, the extenders 320 define flow passages 380*a* through 380*e* of different lengths. The flow passage 380*a* is defined by the extender 320 having the longest length, while the flow passage 380*e* is defined by the extender 320 having the shortest length. The extenders 320 are arranged such that the shortest flow passages 380*e* are proximate the fuel supply line 145, and the longest flow passages 380*a* are farthest from the fuel supply line 145 with flow passages of intermediate lengths (i.e., 380*d*, 380*c*, 380*b* from shortest to longest) being arranged in-between. Of course, it should be noted that the number of different lengths of the extenders 320 may vary, the five different extender lengths being used for illustration, but not limitation, of the adapter 300.

FIG. 10 illustrates an adapter 400 that includes a mounting body 450, which has an upstream surface 452 and a downstream surface 454. Each extender 420 is joined to the mounting body 450 and projects from the upstream surface 452 thereof, such that a flow passage 480 is defined through the extender 420 from the inlet 422 to the outlet 424. A bolt 470, or other fastener removable with hand tools, is disposed at a location radially outward of the center line 165 of the fuel nozzle 110 and secures the adapter 400 to the bundled tube fuel nozzle 110.

In this configuration, the extenders 420 define flow passages 480*a* through 480*e* of different lengths. The flow passage 480*a* is defined by the extender 420 having the longest length, while the flow passage 480*e* is defined by the extender 420 having the shortest length. The extenders 420 are arranged such that the longest flow passages 480*a* are proximate the fuel supply line 145, and the shortest flow passages 480*e* are farthest from the fuel supply line 145 with flow passages of intermediate lengths (i.e., 380*b*, 380*c*, 380*d* from longest to shortest) being arranged in-between. Of course, it should be noted that the number of different lengths of the extenders 420 may vary, the five different extender lengths being used for illustration, but not limitation, of the adapter 400.

FIG. 11 illustrates an adapter 500 that includes a mounting body 550, which has an upstream surface 552 and a downstream surface 554. Each extender 520 is joined to the mounting body 550 and projects from the upstream surface 552 thereof, such that a flow passage 580 is defined through the extender 520 from the inlet 522 to the outlet 524. A bolt 570, or other fastener removable with hand tools, is disposed at a location radially outward of the center line 165 of the fuel nozzle 110 and secures the adapter 500 to the bundled tube fuel nozzle 110.

In this configuration, the extenders 520 define flow passages 580*a* through 580*e* of different lengths. The flow passage 580*a* is defined by the extender 520 having the longest length, while the flow passage 580*e* is defined by the extender 520 having the shortest length. The extenders 520 are not arranged by length, such that the extenders 520 having the longest flow passage 580*a* may be disposed in any row. In one variation, a given first row of extenders 520 has a common first length and define a common first flow passage (e.g., 580*b*), while a second row of extenders 520 has a common second length different from that of the extenders 520 in the first row and define a common second flow passage (e.g., 580*d*). In other variations, the individual rows of extenders in each adapter may include extenders having two or more different lengths. Of course, it should be noted that the number of different lengths of the extenders 520 may vary, the five different extender lengths being used for illustration, but not limitation, of the adapter 500.

In any of FIGS. 9 through 11, the extenders having a first flow passage length may be disposed along a common or single row of the adapter, while the extenders having a second flow passage length may be disposed along another common row of the adapter. In other variations, the extenders having a first flow passage length may disposed along two or more rows of the adapter, while the extenders having a second flow passage length may be disposed along another two or more rows of the adapter.

FIG. 12 illustrates an adapter 600 that includes a mounting body 650, which has an upstream surface 652 and a downstream surface 654. Each extender 620 is joined to the mounting body 650 and projects from the upstream surface 652 thereof, such that a flow passage 680 is defined through the extender 620 from the inlet 622 to the outlet 624. A bolt 670, or other fastener removable with hand tools, is disposed at a location radially outward of the center line 165 of the fuel nozzle 110 and secures the adapter 600 to the bundled tube fuel nozzle 110.

In this configuration, a first portion of the mixing tubes 100 is disposed in one or rows along a radially outer perimeter of the fuel nozzle 110, and the extenders 620 are disposed in one or more rows in fluid communication with the first portion of the mixing tubes. In the event that each fuel nozzle 110 in a combustor cap assembly 50 has the adapter 600 attached thereto, the extender 620 create a circle of extenders 620 about the radially outer perimeter of the fuel nozzles 110.

A second portion of the mixing tubes 100 includes those tubes not disposed proximate the radially outer perimeter. The mounting body 650 defines apertures 642 therethrough, which are aligned with the inlets 142 of the second portion of the mixing tubes 100. The flow passage 680 for those mixing tubes 100 in the second portion of the mixing tubes 100 is lengthened by the thickness of the mounting body 650, rather than the length of the extender 620.

FIG. 13 illustrates an adapter 700 that includes a mounting body 750, which is a monolithic unit. The monolithic unit has an upstream surface 752 and a downstream surface 754. The mounting body defines a plurality of bores 760 that define flow passages 780 from inlets 762 of the bores 760 to outlets 764 of the bores 760. A bolt 770, or other fastener removable with hand tools, is disposed at a location radially outward of the center line 165 of the fuel nozzle 110 and secures the adapter 700 to the bundled tube fuel nozzle 110. In this configuration, the mounting body 750 defines an entire length of the flow passages 780 without the need for individual extenders (e.g., 220).

In an alternate configuration (shown in FIG. 14), a mounting body 850 of an adapter 800 may be a monolithic unit having a thickness (axial distance) that varies across the mounting body 850. For instance, the mounting body 850 may have a thicker portion, defining a longer flow passage 880, along an outer perimeter of the adapter 800 and the fuel nozzle 110. Likewise, flow passages 880 of different lengths (such as those defined by the extenders 320 in FIGS. 9 and 420 in FIG. 10) may be defined through a solid mounting body 850 having a tiered structure, where the height (axial distance) of each tier corresponds to the desired length of the flow passage 880.

In this configuration, an upstream surface 852 of the adapter 800 is non-planar and tiered, while a downstream surface 854 of the adapter 800 is planar for abutting the fuel plenum portion 130 of the fuel nozzle 110. A bolt 870, or other fastener removable with hand tools, is disposed at a location radially outward of the center line 165 of the fuel nozzle 110 and secures the adapter 800 to the bundled tube fuel nozzle 110.

It should be understood that the tiered upstream surface 852 may be oppositely arranged, such that the longer flow passages 880 are proximate the fuel supply line 145. Alternately, the upstream surface 852 may have fewer or more than the five tiers shown for exemplary purposes, and the adjacent tiers need not vary from longest to smallest successively (rather, the tiers may have different heights to resemble the configuration produced by the extenders 520 in FIG. 11).

FIG. 15 illustrates an adapter 900 that is formed integrally with the fuel plenum portion 130 of the bundled tube fuel nozzle 110. In this embodiment, the individual fuel injection segments 140 of the mixing tubes 100 are extended in an upstream direction beyond the upstream plate 132 that defines the fuel plenum 138. The fuel injection segment extenders 140*a* through 140*e* (i.e., that portion of the fuel injection segments 140 extending upstream of the upstream plate 132) may be produced integrally with the fuel plenum portion 130, if the fuel plenum portion 130 is made by additive manufacturing techniques, as discussed above. Alternately, the fuel injection segments 140 may be made of tubes that have a length greater than the axial length of the housing 136 and the respective upstream and downstream plates 132, 134 and that are joined to the upstream and downstream plates 132, 134, such that the inlet ends 142 of the tubes reside in one or more axial planes upstream of the upstream plate while the outlet ends 144 of the tubes are flush with the surface of the downstream plate 134.

The fuel injection segments 140 may have different lengths (as shown), or the fuel injection segments 140 may have a uniform length, which is greater than the axial length of the fuel plenum portion 130. The extended fuel injection segments 140*a* through 140*e* may be arranged in any manner suitable for tuning the combustion dynamics frequencies of interest. In the particular embodiment illustrated, the arrangement of the extended fuel injection segments 140 is not based on their axial length.

Thus, the need for a separate mounting body (e.g., 250) is eliminated. However, because the adapter 900 lacks the flexibility imparted by the removable adapters described previously, the adapter 900 may be best suited for those applications where the frequencies of interest are well-understood and/or accurately predicted.

While FIGS. 1 through 4 illustrate a can-annular combustion system 24, it should be appreciated that the presently described bundled tube fuel nozzles 110 and their adapters (e.g., 200 through 900) may be used as burners in an annular combustion system, as shown in FIG. 16. The annular combustor 1000 includes an outer liner 1002 and an inner liner 1004, which are disposed concentrically about the gas turbine shaft 30 and which define therebetween an annulus for the flow of combustion products into the turbine section 28 (as shown in FIG. 1). The bundled tube fuel nozzles 1110 are distributed circumferentially about the upstream portion of the annulus between the inner liner 1004 and the outer liner 1002.

At least one of the bundled tube fuel nozzles 1110 may be provided with one of the adapters 200 through 900, as described above. Alternately, an alternating pattern of bundled tube fuel nozzles 1110 with adapters (e.g., 200) may be employed. In another embodiment, some but not all of the bundled tube fuel nozzles 1110 may be outfitted with adapters (e.g., 200). In yet another embodiment, one or more of the bundled tube fuel nozzles 1110 may be provided with a first adapter (e.g., 200), while one or more of the remaining bundled tube fuel nozzles 1110 may be provided with a second adapter (e.g., 500). In another embodiment, all the bundled tube fuel nozzles 1110 of the annular combustor 1000 may be provided with an adapter (e.g., 200), although not necessarily of the same type.

The devices described herein help to mitigate combustion dynamics that may arise from the use of bundled tube fuel nozzles in a power-generating gas turbine combustor and, specifically, those tones that are in-phase with the resonant frequency of the combustor. The present devices therefore facilitate a reduction in the dynamics associated with the operation of a combustor such as, for example, a combustor in a turbine assembly.

Exemplary embodiments of the adapter for use with a bundled tube fuel nozzle or a combustor including a plurality of bundled tube fuel nozzles are described above in detail. The devices described herein are not limited to the specific embodiments described and illustrated, but rather, components of the various devices may be utilized independently and separately from other components described herein. For example, the devices described herein may have other applications not limited to practice with turbine assemblies, as described herein. Rather, the devices described herein can be implemented and utilized in connection with various other industries.

While the invention has been described in terms of various specific embodiments, those skilled in the art will recognize that the invention can be practiced with modification within the spirit and scope of the claims.

What is claimed is:

1. A bundled tube fuel nozzle comprising:

a fuel plenum portion having a common fuel chamber surrounded by an upstream plate, a downstream plate, and a housing, wherein the common fuel chamber extends an axial distance between a first interior surface of the upstream plate and a second interior surface of the downstream plate, wherein the housing extends circumferentially about a central axis and the housing extends axially between the upstream plate and the downstream plate, wherein the common fuel chamber extends circumferentially about the central axis to a third interior surface of the housing;

a fuel supply line coupled to the fuel plenum portion, wherein the fuel supply line extends along the central axis and opens into the common fuel chamber;

a plurality of tubes extending in parallel through the common fuel chamber between the upstream plate and the downstream plate, wherein each tube of the plurality of tubes comprises a tube side wall disposed circumferentially about an axial passage from an inlet to an outlet, at least one fuel injection port defined laterally through the tube side wall in fluid communication with the common fuel chamber, and an exterior circumferential surface of the tube side wall disposed directly in the common fuel chamber; and an adapter removably coupled to the upstream plate, wherein the adapter comprises:

a mounting body comprising a planar downstream surface and an opening at the central axis, wherein the mounting body extends circumferentially about the opening, and the fuel supply line extends through the opening, wherein the mounting body has a truncated wedge shape having a pair of radial sides that extend in opposite directions and that are joined by a radially inner arcuate side and a radially outer arcuate side; and a plurality of extender tubes coupled to and extending upstream of the mounting body, wherein each extender tube of the plurality of extender tubes comprises a flow passage aligned with the inlet of one tube of the plurality of tubes to extend an axial length of the one tube of the plurality of tubes in an upstream direction, exterior surfaces of the plurality of extender tubes being spaced apart from one another upstream of the mounting body, and each extender tube of the plurality of extender tubes being upstream from the common fuel chamber and the at least one fuel injection port of the one tube of the plurality of tubes;

wherein the planar downstream surface of the adapter comprises at least one hole configured to receive a removable fastener;

wherein the adapter is removably coupled to the bundled tube fuel nozzle by the removable fastener, such that:

when the adapter is coupled to the bundled tube fuel nozzle, the planar downstream surface contacts the upstream plate of the bundled tube fuel nozzle between the inlets of the plurality of tubes; and when the adapter is removed from the bundled tube fuel nozzle, the plurality of extender tubes remain affixed to the mounting body.

2. The fuel nozzle of claim 1, wherein each extender tube of the plurality of extender tubes comprises an annular wall extending from an extender inlet to an extender outlet, and the annular wall completely encloses the flow passage between the extender inlet and the extender outlet.

3. The fuel nozzle of claim 2, wherein the plurality of tubes comprises a first portion of tubes disposed along a radially outer perimeter of the fuel nozzle relative to the central axis and a second portion of tubes disposed radially inward of the first portion of tubes relative to the central axis; and wherein the plurality of extender tubes is in fluid communication with the first portion of tubes; and wherein the mounting body defines apertures therethrough, the apertures being aligned with the inlets of the second portion of tubes.

4. The fuel nozzle of claim 1, wherein the plurality of extender tubes defines a first length, the first length being common to each extender tube of the plurality of extender tubes.

5. The fuel nozzle of claim 1, wherein the plurality of extender tubes includes at least one first extender tube defining a first length, and at least one second extender tube defining a second length different from the first length.

6. The fuel nozzle of claim 5, wherein the at least one first extender tube defining the first length is proximate the central axis, and the at least one second extender tube defining the second length is distal to the central axis.

7. The fuel nozzle of claim 6, wherein the first length is shorter than the second length.

8. The fuel nozzle of claim 6, wherein the first length is longer than the second length.

9. The fuel nozzle of claim 1, wherein the mounting body is coupled to the upstream plate via a plurality of removable fasteners, including the removable fastener.

10. The fuel nozzle of claim 1, wherein the removable fastener comprises a threaded fastener.

11. The fuel nozzle of claim 1, wherein the fuel supply line has a greater inner diameter than each tube of the plurality of tubes and each extender tube of the plurality of extender tubes.

12. The fuel nozzle of claim 1, wherein the fuel supply line is parallel to the plurality of tubes and the plurality of extender tubes.

13. The fuel nozzle of claim 1, wherein the plurality of extender tubes change acoustic pressure oscillations within the plurality of tubes to cause the acoustic pressure oscillations to be out-of-phase with resonance modes of a combustor.

14. The fuel nozzle of claim 13, wherein the additional axial length provided by each extender tube of the plurality of extender tubes does not change a residence time of mixing of fuel and air in the bundled tube fuel nozzle, wherein the fuel is provided through the at least one fuel injection port of each tube of the plurality of tubes.

15. An adapter configured for mitigating dynamics in a bundled tube fuel nozzle, the bundled tube fuel nozzle comprising a plurality of tubes extending through a common fuel chamber of a fuel plenum portion, each of the plurality of tubes having at least one fuel injection port in fluid communication with the common fuel chamber, the adapter comprising:

a mounting body comprising a planar downstream surface and an opening at a central axis, wherein the mounting body extends circumferentially about the opening, wherein the opening is configured to removably extend around a fuel supply line coupled to the fuel plenum portion, wherein the mounting body has a truncated wedge shape having a pair of radial sides that extend in opposite directions and that are joined by a radially inner arcuate side and a radially outer arcuate side; and a plurality of extender tubes coupled to and extending upstream of the mounting body, wherein each extender tube of the plurality of extender tubes comprises a flow passage aligned with an inlet of one tube of the plurality of tubes to extend an axial length of the one tube of the plurality of tubes in an upstream direction, exterior surfaces of the plurality of extender tubes being spaced apart from one another upstream of the mounting body, and each extender tube of the plurality of extender tubes being configured to be positioned upstream from the common fuel chamber and the at least one fuel injection port of the one tube of the plurality of tubes;

wherein the planar downstream surface comprises at least one hole configured to receive a removable fastener;

wherein the adapter is configured to be removably coupled to the bundled tube fuel nozzle by the removable fastener, such that:

when the adapter is coupled to the bundled tube fuel nozzle, the planar downstream surface contacts the bundled tube fuel nozzle between respective inlets of the plurality of tubes; and when the adapter is separated from the bundled tube fuel nozzle, the plurality of extender tubes remain affixed to the mounting body.

16. The adapter of claim 15, wherein the plurality of extender tubes is configured to change acoustic pressure oscillations within the respective plurality of tubes to be out-of-phase with resonance modes of a combustor, wherein the adapter having the plurality of extender tubes is selected from a plurality of adapters having different configurations of the plurality of extender tubes to cause different acoustic pressure oscillations, wherein each of the plurality of adapters is configured to removably couple to the bundled tube fuel nozzle.

17. A system, comprising:

a bundled tube fuel nozzle, comprising:

a fuel plenum portion comprising a common fuel chamber extending circumferentially about a central axis;

a fuel supply line coupled to the fuel plenum portion;

a plurality of tubes extending separately through the common fuel chamber in an axial direction relative to the central axis, wherein each tube of the plurality of tubes includes at least one fuel injection port in fluid communication with the common fuel chamber;

a plurality of mixing tubes coupled to the respective plurality of tubes, wherein the plurality of mixing tubes extend downstream from the respective plurality of tubes in the axial direction relative to the central axis;

an adapter removably coupled to the fuel plenum portion via a removable fastener, wherein the adapter comprises:

a mounting body comprising an opening at the central axis, wherein the mounting body extends circumferentially about the opening, and the fuel supply line extends through the opening, wherein the mounting body has a truncated wedge shape having a pair of radial sides that extend in opposite directions and that are joined by a radially inner arcuate side and a radially outer arcuate side; and a plurality of extender tubes coupled to and extending upstream of the mounting body, wherein the plurality of extender tubes extend upstream from the respective plurality of tubes in the axial direction relative to the central axis;

wherein the adapter having the mounting body and the plurality of extender tubes is removable from the bundled tube fuel nozzle via separation along the fuel supply line via the opening in the mounting body.

18. The system of claim 17, wherein the plurality of tubes are disposed at a plurality of different distances relative to the central axis, the plurality of mixing tubes are disposed at the plurality of different distances relative to the central axis, and the plurality of extender tubes are disposed at the plurality of different distances relative to the central axis.

19. The system of claim 17, wherein the plurality of extender tubes have a respective plurality of different lengths extending upstream from the mounting body.

20. The system of claim 17, wherein the plurality of extender tubes is configured to change acoustic pressure oscillations within the respective plurality of mixing tubes to be out-of-phase with resonance modes of a combustor, wherein the adapter having the plurality of extender tubes is selected from a plurality of adapters having different configurations of the plurality of extender tubes to cause different acoustic pressure oscillations, wherein each of the plurality of adapters is configured to removably couple to the bundled tube fuel nozzle.

* * * * *